US008714548B2

(12) United States Patent
Horade et al.

(10) Patent No.: US 8,714,548 B2
(45) Date of Patent: May 6, 2014

(54) IMAGE RECORDING APPARATUS

(71) Applicants: Kenta Horade, Tokai (JP); Keisuke Wakakusa, Nagoya (JP)

(72) Inventors: Kenta Horade, Tokai (JP); Keisuke Wakakusa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/851,561

(22) Filed: Mar. 27, 2013

(65) Prior Publication Data

US 2013/0256983 A1 Oct. 3, 2013

(30) Foreign Application Priority Data

Mar. 27, 2012 (JP) ..... 2012-072603

(51) Int. Cl.
*B65H 7/02* (2006.01)

(52) U.S. Cl.
USPC ..... 271/265.02; 271/264; 271/225

(58) Field of Classification Search
USPC ..... 271/225, 264, 265.01, 265.02
See application file for complete search history.

(56) References Cited

U.S. PATENT DOCUMENTS

| | | | | |
|---|---|---|---|---|
| 7,942,416 | B2 * | 5/2011 | Muratani et al. | 271/291 |
| 8,210,636 | B2 * | 7/2012 | Uematsu | 347/16 |
| 2008/0157460 | A1 | 7/2008 | Izuchi et al. | |
| 2009/0035018 | A1 | 2/2009 | Koga et al. | |
| 2009/0035019 | A1 | 2/2009 | Koga et al. | |
| 2010/0061743 | A1 | 3/2010 | Uematsu | |

FOREIGN PATENT DOCUMENTS

| | | | |
|---|---|---|---|
| JP | 2008-162736 | A | 7/2008 |
| JP | 2009-034847 | A | 2/2009 |
| JP | 2010-058952 | A | 3/2010 |

* cited by examiner

*Primary Examiner* — Michael McCullough
*Assistant Examiner* — Howard Sanders
(74) *Attorney, Agent, or Firm* — Merchant & Gould P.C.

(57) ABSTRACT

An image recording apparatus includes: a first motor for rotating first and second rollers; a second motor; a recording portion provided downstream of the first roller, the second roller provided downstream of the recording portion; a sensor portion provided between the recording portion and the second roller to sense a sheet; and a first gear movable between a first position and a second position where reverse rotational power of the first roller is transmitted to the second roller. When a controller determines that an upstream edge of the sheet in a conveying direction has reached a third position located between the recording portion and the sensor portion, the controller starts driving the second motor to move the first gear from the first position to the second position and thereafter controls the first motor to perform a forward rotation and a reverse rotation alternately a set number of times.

9 Claims, 12 Drawing Sheets

FIG.8

| SWITCH GEAR 51 | FIRST POWER TRANSMISSION POSITION | | SECOND POWER TRANSMISSION POSITION | |
|---|---|---|---|---|
| CONVEYOR MOTOR 71 | FORWARD ROTATION | REVERSE ROTATION | FORWARD ROTATION | REVERSE ROTATION |
| FIRST CONVEYOR ROLLER 60 | FIRST DIRECTION (FIRST POWER TRANSMITTER 26) | DIRECTION OPPOSITE TO FIRST DIRECTION (FIRST POWER TRANSMITTER 26) | FIRST DIRECTION (FIRST POWER TRANSMITTER 26) | DIRECTION OPPOSITE TO FIRST DIRECTION (FIRST POWER TRANSMITTER 26) |
| SECOND CONVEYOR ROLLER 62 | FIRST DIRECTION (FIRST POWER TRANSMITTER 26) | STOPPED | FIRST DIRECTION (FIRST POWER TRANSMITTER 26) | DIRECTION OPPOSITE TO FIRST DIRECTION (SECOND POWER TRANSMITTER 27) |
| THIRD CONVEYOR ROLLER 45 | FIRST DIRECTION (THIRD POWER TRANSMITTER 33) | STOPPED | FIRST DIRECTION (THIRD POWER TRANSMITTER 33) | DIRECTION OPPOSITE TO FIRST DIRECTION (THIRD POWER TRANSMITTER 33) |
| FOURTH CONVEYOR ROLLER 68 | STOPPED | STOPPED | SECOND DIRECTION (FOURTH POWER TRANSMITTER 28) | SECOND DIRECTION (FOURTH POWER TRANSMITTER 28) |
| SUPPLY ROLLER 25 | STOPPED | FIRST DIRECTION (SUPPLY POWER TRANSMITTER 29) | STOPPED | STOPPED |

IMAGE RECORDING APPARATUS

CROSS REFERENCE TO RELATED APPLICATION

The present application claims priority from Japanese Patent Application No. 2012-072603, which was filed on Mar. 27, 2012, the disclosure of which is herein incorporated by reference in its entirety.

BACKGROUND OF THE INVENTION

1. Field of the Invention

The present invention relates to an image recording apparatus configured to convey a sheet along a conveyance path and record an image on the sheet.

2. Description of the Related Art

There is conventionally known an image recording apparatus configured to record an image on a sheet. Examples of such an image recording apparatus include an ink jet image recording apparatus and an electrophotographic image recording apparatus.

To satisfy recent demand for reducing size and cost of an image recording apparatus, the number of motors provided in the image recording apparatus is preferably reduced. For example, there is known an image recording apparatus that includes: a drive gear to which a driving power is transmitted from a motor; and a switch gear slidable in thrust directions of the drive gear while meshed with the drive gear. In this image recording apparatus, a plurality of transmission gears for transmitting the power to various mechanisms are arranged respectively corresponding to slide positions of the switch gear. The switch gear is slidable and meshable selectively with one of the transmission gears. A power transmission switching mechanism having this construction reduces the number of motors provided in the image recording apparatus.

In this power transmission switching mechanism, when the switch gear is slid and newly meshed with one of the transmission gears, the motor needs to repeatedly perform forward and reverse rotation by a small rotational amount. As a result, the switch gear is smoothly meshed with the transmission gear.

Also, many recent image recording apparatuses have a duplex image recording function. For example, there is an image recording apparatus having a resupply conveyance path in addition to a main conveyance path for conveying a sheet from a supply tray to an output opening via a recording portion for recording an image on the sheet. The resupply conveyance path is a path through which a sheet with an image recorded on its front face by the recording portion is conveyed from a position downstream of the recording portion in a sheet conveying direction, to a position upstream of the recording portion in the sheet conveying direction in the main conveyance path.

In this image recording apparatus, a roller rotatable forwardly and reversely is provided downstream of the recording portion. This roller is rotated forwardly to discharge the sheet through the output opening and rotated reversely to guide the sheet to the resupply conveyance path. Also, a sensor is disposed between the recording portion and the roller in the main conveyance path. A timing when the rotation of the roller is switched from the forward rotation to the reverse rotation for guiding the sheet to the resupply conveyance path is determined on the basis of a timing when the sensor senses the conveyed sheet.

SUMMARY OF THE INVENTION

However, in a case where the sensor is of a type whose orientation is changed by being pushed by the conveyed sheet, the following problem may arise. That is, some length of time is required from the change in orientation of the sensor, to a timing when a signal based on the change in orientation of the sensor is output from the sensor to a controller of the image recording apparatus. If the sheet is conveyed at a high speed in that time period, a difference in time is produced between the timing of the actual pressing of the sheet on the sensor and the timing of the response of the sensor. That is, there is a possibility that the timing when the rotation of the above-described roller is switched from the forward rotation to the reverse rotation is delayed, resulting in a reduction in accuracy of sensing a sheet by the sensor.

The present invention has been developed to provide an image recording apparatus capable of suppressing a reduction in accuracy of sensing a sheet by a sensor even in a case where the sheet is conveyed at a high speed under normal conditions.

The present invention provides an image recording apparatus, comprising: a first motor configured to perform a forward rotation and a reverse rotation; a first roller rotatable to produce a rotational driving power, wherein, when the first motor performs the forward rotation, the first roller is rotated in a first rotational direction to produce a first rotational driving power and to convey a sheet in a conveying direction along a conveyance path, and wherein, when the first motor performs the reverse rotation, the first roller is rotated in a second rotational direction reverse to the first rotational direction to produce a second rotational driving power; a second motor configured to perform a forward rotation and a reverse rotation; a recording portion provided downstream of the first roller in the conveying direction and movable in main scanning directions perpendicular to the conveying direction by the forward rotation and the reverse rotation of the second motor to record an image on the sheet; a second roller provided downstream of the recording portion in the conveying direction; a first power transmitter configured to transmit the first rotational driving power of the first roller to the second roller to rotate the second roller in a third rotational direction for conveying the sheet in the conveying direction; a second power transmitter configured to transmit the second rotational driving power of the first roller to the second roller to rotate the second roller in a fourth rotational direction that is reverse to the third rotational direction; a first sensor portion provided upstream of the first roller in the conveying direction and configured to produce a first sense signal when the sheet is conveyed through the first sensor portion; a second sensor portion configured to produce a second sense signal when the first roller is rotated; a third sensor portion provided between the recording portion and the second roller in the conveying direction and configured to produce a third sense signal when the sheet is conveyed through the third sensor portion; a switcher configured to switch whether the rotational driving power of the first roller is transmitted to the second power transmitter; and a controller configured to control the first motor and the second motor based on at least one of the first sense signal, the second sense signal, and the third sense signal, wherein the switcher comprises: a first gear movable between a first position and a second position by movement of the recording portion and configured to rotate in conjunction with rotation of the first roller; a second gear meshable with the first gear located at the second position, the second gear being configured to transmit the rotational driving power of the first roller to the second power transmitter when the second gear is meshed with the first gear located at the second position; and a force apply portion configured to apply a force to the first gear in a direction directed from the first position toward the second position, and wherein the controller is configured to execute: a determination processing in which the controller determines, based on the first sense signal and the second sense signal, whether an upstream edge of the sheet in the conveying direction has reached a third position located between the recording portion and the third sensor portion in the conveying direction; and a forward and reverse rotation control in which, when the controller determines that the upstream edge of the sheet in the conveying direction has reached the third position in the determination processing, the controller starts driving the second motor to move the first gear from the first position to the second position and thereafter controls the first motor to perform the forward rotation and the reverse rotation alternately a set number of times.

BRIEF DESCRIPTION OF THE DRAWINGS

The objects, features, advantages, and technical and industrial significance of the present invention will be better understood by reading the following detailed description of embodiments of the invention, when considered in connection with the accompanying drawings, in which:

FIG. 8 is a table for explaining sheet conveying directions by supply rollers 25 and conveyor rollers 60, 62, 45, 68, which are determined by a position of the switch gear 51 and a forward or a reverse rotation of a conveyor motor 71;

DETAILED DESCRIPTION OF THE EMBODIMENTS

Figure 1:
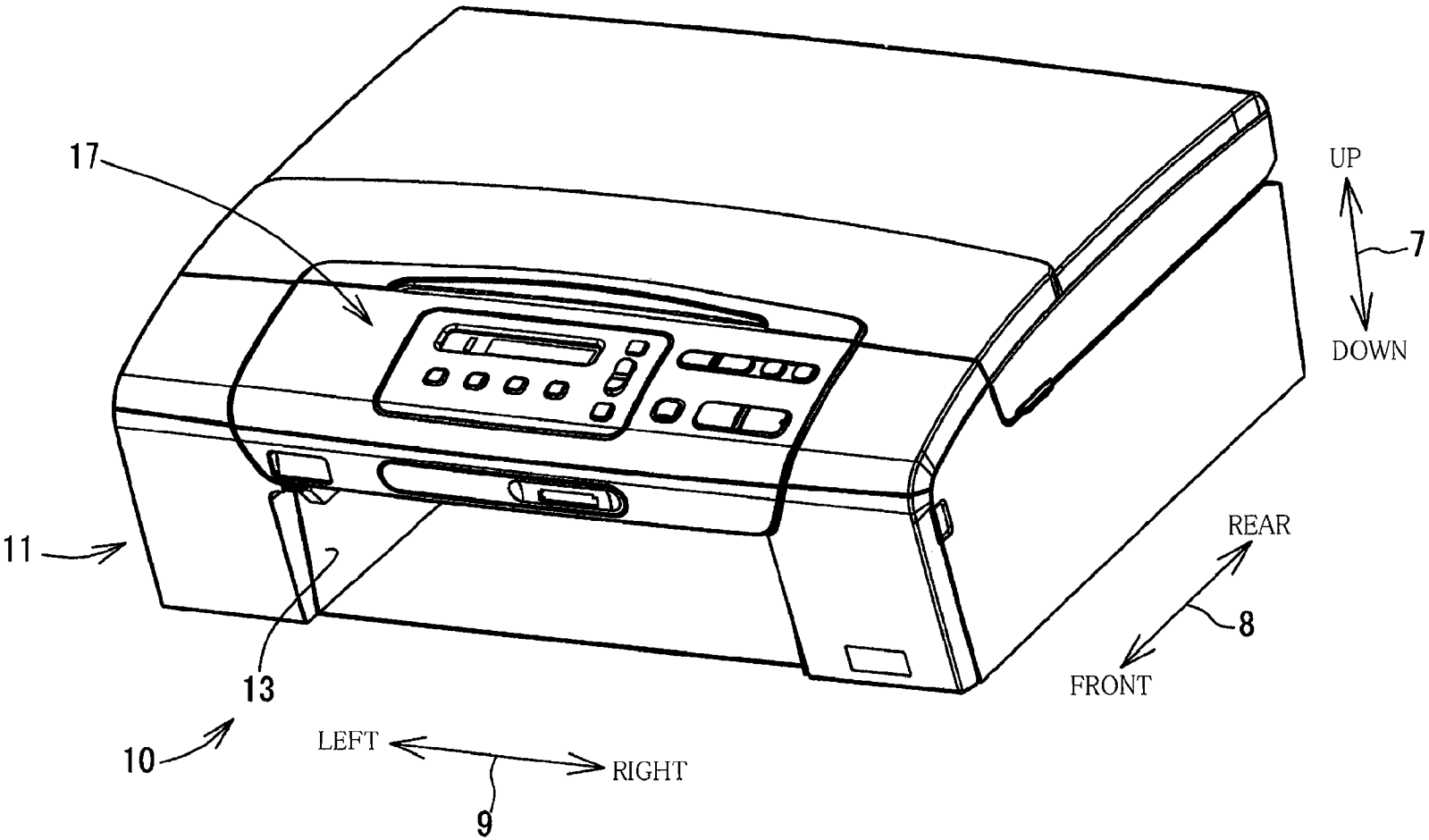
FIG. 1 is a perspective view illustrating an MFP 10.

Hereinafter, there will be described embodiments of the present invention by reference to the drawings. It is to be understood that the following embodiments are described only by way of example, and the invention may be otherwise embodied with various modifications without departing from the scope and spirit of the invention. A multi-function peripheral (MFP) 10 is used in a state illustrated in FIG. 1. In the present embodiment, three arrows illustrated in FIG. 1 indicate up and down directions 7, front and rear directions 8, and right and left directions 9. In the following explanation, the up and down directions 7 are defined as up and down directions of the MFP 10 illustrated in FIG. 1, i.e., the MFP 10 being in a normal state. Also, the front and rear directions 8 are defined by regarding a side of the MFP 10 on which an opening 13 is formed as a front side, and the right and left directions 9 are defined in a state in which the MFP 10 is seen from the front side. It is noted that the directions illustrated in FIG. 1 are also indicated in other drawings in a similar manner. Also, in the following explanation, the term "direction" means a one-way direction which is directed from one point toward another point, and the term "directions" means opposite directions. That is, the term "directions" includes a direction directed from one point toward another point and a direction directed from said another point toward the one point.

Overall Structure of MFP 10

The MFP 10 is one example of an image recording apparatus as one embodiment according to the present invention. As illustrated in FIG. 1, the MFP 10 includes a printing section 11 at its lower portion. The MFP 10 has various functions such as a facsimile function and a printing function. The printing function includes a duplex image recording function for recording images on front and back faces of a recording sheet 12 as one example of a sheet (see FIG. 2). The printing section 11 has the opening 13 in its front face. The MFP 10 includes: a supply tray 20 (see FIG. 2) on which the recording sheet 12 can be placed; and an output tray 21 (see FIG. 2). These trays 20, 21 can be inserted or removed through the opening 13 in the front and rear directions 8. It is noted that the MFP 10 can perform image recording not only on the recording sheet 12 but also on, e.g., a label face of a CD or a DVD. In this case, the CD or DVD is placed on a thin-plate shaped media tray and inserted into the MFP 10 through, e.g., the opening 13.

Figure 2:
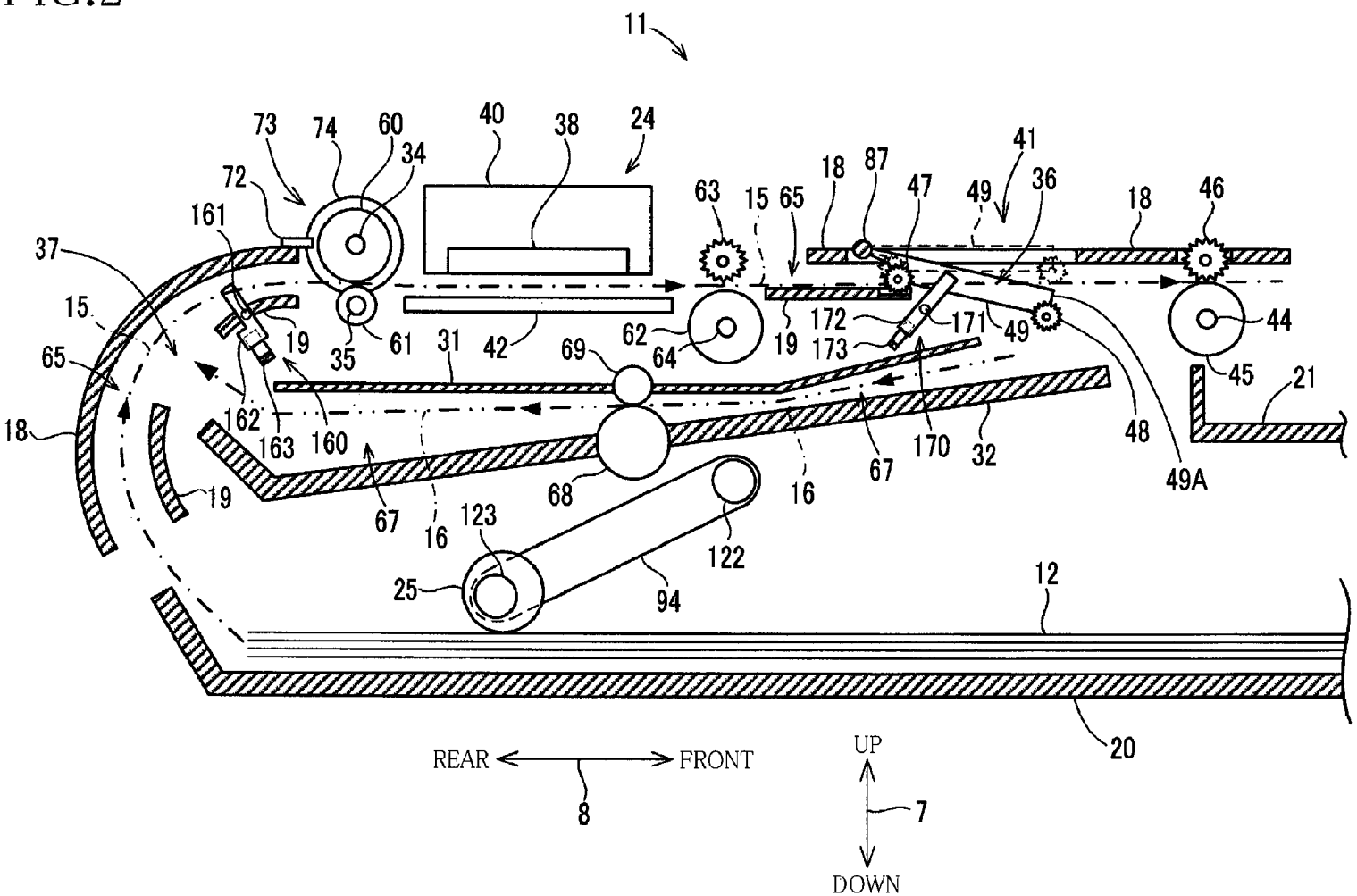
FIG. 2 is an elevational view in vertical cross section schematically illustrating an internal structure of a printing section 11.

As illustrated in FIG. 2, supply rollers 25 are provided on an upper side of the supply tray 20. The supply tray 20 has a sheet-placed portion, i.e., an upper face, on which the recording sheet 12 is placed. The supply rollers 25 can contact the recording sheet 12 placed on the sheet-placed portion of the supply tray 20 from an upper side of the recording sheet 12. The supply rollers 25 are rotated in a second rotational direction (clockwise direction in FIG. 2) by receiving a driving power from a conveyor motor 71 (as one example of a first motor, see FIGS. 3-5 and 9) rotating in its reverse direction. As a result, the recording sheet 12 placed on the supply tray 20 is supplied to a first conveyor roller 60 through a first conveyance path 65 as one example of a conveyance path. It is noted that when the supply rollers 25 are rotated in the second rotational direction, the recording sheet 12 is conveyed in a first direction 15. Power transmission from the first conveyor roller 60 and the conveyor motor 71 to the supply rollers 25 will be explained later.

The first conveyance path 65 extends from a rear end portion of the supply tray 20. The first conveyance path 65 includes a curved portion and a straight portion. The first conveyance path 65 is defined by an outer guide member 18 and an inner guide member 19 which are opposed to each other at a predetermined distance therebetween. The recording sheet 12 placed on the supply tray 20 is conveyed through the curved portion from its lower side toward upper side so as to make a U-turn. The recording sheet 12 is then conveyed to a recording portion 24 through the straight portion. The recording portion 24 performs image recording on the recording sheet 12. After the image recording, the recording sheet 12 is conveyed through the straight portion and discharged onto the output tray 21. That is, the recording sheet 12 is conveyed in the first direction 15 (as one example of a conveying direction) indicated by one-dot chain-line arrow in FIG. 2. It is noted that the recording portion 24 will be explained later in detail.

First Embodiment

First Conveyor Roller 60, Second Conveyor Rollers 62, and Third Conveyor Rollers 45

As illustrated in FIG. 2, a plurality of roller pairs are provided in the first conveyance path 65. Specifically, a pair of the first conveyor roller 60 (as one example of a first roller) and pinch rollers 61 are provided upstream of the recording portion 24 in the first direction 15. Also, a pair of a spur 63 and second conveyor rollers 62 are provided downstream of the recording portion 24 in the first direction 15. Also, a pair of a spur 46 and third conveyor rollers 45 (as one example of a second roller) are provided downstream of the second conveyor rollers 62 in the first direction 15. Each of the roller pairs is rotated while nipping the recording sheet 12 to convey the recording sheet 12.

The first conveyor roller 60 is rotated by a driving power transmitted from the conveyor motor 71. The conveyor motor 71 is rotatable in its forward direction or reverse direction. When a driving power produced by the forward rotation of the conveyor motor 71 is transmitted to the first conveyor roller 60, the first conveyor roller 60 is rotated in a first rotational direction (counterclockwise direction in FIG. 2). As for the first conveyor roller 60, the first rotational direction is a rotational direction to convey the recording sheet 12 in the first direction 15. When a driving power produced by the reverse rotation of the conveyor motor 71 is transmitted to the first conveyor roller 60, the first conveyor roller 60 is rotated in a second rotational direction (clockwise direction in FIG. 2) reverse to the first rotational direction to convey the recording sheet 12 in a direction opposite to the first direction 15. The first conveyor roller 60 transmits the power to the second conveyor rollers 62 and the third conveyor rollers 45 via a drive-power transmitting mechanism 50 (see FIGS. 3-6) which will be described below.

It is noted that, in the present embodiment, the first conveyor roller 60 contacts a recording face of the sheet conveyed through the first conveyance path 65 (i.e., a face of the sheet on which an image is recorded by the recording portion 24 which will be described below), and each of the second conveyor rollers 62 and the third conveyor rollers 45 contacts a face of the sheet which is on a back of the recording face. That is, explaining with reference to FIG. 2, when the first conveyor roller 60 is rotated in the counterclockwise direction (i.e., the first rotational direction) to convey the recording sheet 12 in the first direction 15, the second conveyor rollers 62 and the third conveyor rollers 45 are rotated in the clockwise direction (i.e., the second rotational direction). On the other hand, when the first conveyor roller 60 is rotated in the clockwise direction (i.e., the second rotational direction), each of the second conveyor rollers 62 and the third conveyor rollers 45 is rotated in the counterclockwise direction (i.e., the first rotational direction).

The first conveyance path 65 includes a branch portion 36 between the second conveyor rollers 62 and the third conveyor rollers 45. In the duplex image recording, a moving direction of the recording sheet 12 conveyed along the first conveyance path 65 is switched to a rearward direction at a position downstream of the branch portion 36, and then the recording sheet 12 is conveyed toward a second conveyance path 67 (as one example of a flip conveyance path) which will be described below.

Recording Portion 24

As illustrated in FIG. 2, the recording portion 24 is provided downstream of the first conveyor roller 60 and upstream of the second conveyor rollers 62 in the first direction 15. A platen 42 is provided under the recording portion 24 so as to be opposed to the recording portion 24. The platen 42 supports the recording sheet 12 conveyed through the first conveyance path 65. The recording portion 24 employs a well-known ink-jet ejection method to record an image on the recording sheet 12 supported on the platen 42. The recording portion 24 includes: a recording head 38 having a multiplicity of nozzles to eject ink droplets onto the recording sheet 12 therethrough; and a carriage 40 for holding the recording head 38 mounted thereon.

The carriage 40 is supported by, e.g., a frame of the printing section 11 so as to be reciprocable in main scanning directions that coincide with the right and left directions 9 perpendicular to the front and rear directions 8. The carriage 40 is coupled to a carriage drive motor 53 (as one example of a second motor, see FIG. 9) by a well-known belt mechanism. Upon receipt of a driving power transmitted from the carriage drive motor 53, the carriage 40 is reciprocated in the right and left directions 9. This reciprocation of the carriage 40 is performed in a state in which the recording sheet 12 is supported on the platen 42. The recording head 38 ejects ink droplets in the reciprocation of the carriage 40. As a result, an image is recorded on the recording sheet 12 supported on the platen 42.

First Sensor 160 and Second Sensor 170

As illustrated in FIG. 2, a first sensor 160 is provided in the first conveyance path 65 at a position upstream of the first conveyor roller 60 in the first direction 15. The first sensor 160 includes: a shaft 161; a detector 162 pivotable about the shaft 161; and an optical sensor 163 that includes a light emitting element and a light receiving element for receiving light emitted from the light emitting element.

One end of the detector 162 projects into the first conveyance path 65. When an external force is not applied to the one end of the detector 162, the other end of the detector 162 is located in a light path extending from the light emitting element to the light receiving element to interrupt the light traveling through the light path. In this state, the optical sensor 163 outputs a low-level signal to a controller 130 which will be described below. When the one end of the detector 162 is pressed by a downstream edge of the recording sheet 12 in the first direction 15 to rotate the detector 162, the other end of the detector 162 is moved out of the light path, causing the light to pass through the light path. In this state, the optical sensor 163 outputs a high-level signal to the controller 130. On the basis of the signal received from the optical sensor 163, the controller 130 senses the downstream edge (i.e., a leading edge) and an upstream edge (i.e., a trailing edge) of the recording sheet 12 in the first direction 15. The first sensor 160 is one example of a first sensor portion.

A second sensor 170 is provided in the first conveyance path 65 at the branch portion 36 located between the recording portion 24 and the third conveyor rollers 45. The second sensor 170 is similar in construction to the first sensor 160 and includes a shaft 171, a detector 172, and an optical sensor 173. The second sensor 170 operates in the same manner as the first sensor 160. On the basis of the signal received from the optical sensor 173, the controller 130 senses the downstream edge and the upstream edge of the recording sheet 12 in the first direction 15. The second sensor 170 is one example of a third sensor portion.

Rotary Encoder 73

As illustrated in FIG. 2, the first conveyor roller 60 is provided with a rotary encoder 73 that produces a pulse signal in response to the rotation of the first conveyor roller 60. The rotary encoder 73 includes an optical sensor 72 and an encoder disc 74 provided on a shaft 34 of the first conveyor roller 60 so as to be rotated along with the first conveyor roller 60. The encoder disc 74 includes: light transmitting portions allowing light to pass therethrough; and light intercepting portions inhibiting the light from passing therethrough. These light transmitting portions and light intercepting portions are alternately arranged at regular pitches in a circumferential direction so as to form a predetermined pattern. The rotary encoder 73 produces a pulse signal each time when the light transmitting portion and the light intercepting portion are sensed by the optical sensor 72 during the rotation of the encoder disc 74. The produced pulse signals are transmitted to the controller 130. The controller 130 detects a rotational amount of the first conveyor roller 60 on the basis of the pulse signals. As will be described below, the conveyor rollers 60, 62, 45 are coupled to one another by belts. Thus, the controller 130 can also detect rotational amounts of the second conveyor rollers 62 and the third conveyor rollers 45 on the basis of the pulse signals. The rotary encoder 73 is one example of a second sensor portion.

Path Switching Member 41 and Second Conveyance Path 67

As illustrated in FIG. 2, a path switching member 41 is provided at the branch portion 36 located in the first conveyance path 65 between the second conveyor rollers 62 and the third conveyor rollers 45. The path switching member 41 includes auxiliary rollers 47, 48, a flap 49, and a shaft 87. The flap 49 is pivotably supported by the shaft 87 so as to extend from the shaft 87 substantially in the first direction 15. The auxiliary rollers 47, 48 each having a spur shape are provided respectively on shafts provided on the flap 49.

The flap 49 is pivoted between (i) a discharge orientation, indicated by broken lines in FIG. 2, in which the flap 49 is located at an upper portion of the branch portion 36 above the inner guide member 19 and (ii) a flip orientation, indicated by solid lines in FIG. 2, in which a free end portion 49A of the flap 49 is located at a lower portion of the branch portion 36.

In a normal state of the MFP 10, the flap 49 is in the flip orientation by its own weight. When the recording sheet 12 conveyed through the first conveyance path 65 comes into contact with the flap 49, the flap 49 is moved upward so as to be pivoted to the discharge orientation. The flap 49 (specifically, the auxiliary rollers 47, 48) thereafter guides the recording sheet 12 while contacting the recording sheet 12. When the upstream edge of the recording sheet 12 in the first direction 15 passes through the auxiliary roller 47, the flap 49 is pivoted by its own weight from the discharge orientation to the flip orientation. As a result, the upstream edge of the recording sheet 12 in the first direction 15 is moved downward so as to be directed toward (i.e., so as to face or point) the second conveyance path 67 which will be described below. When the third conveyor rollers 45 continue to be rotated in the second rotational direction in this state, the recording sheet 12 is conveyed in the first direction 15 and discharged onto the output tray 21. On the other hand, when a rotational direction of the third conveyor rollers 45 is switched to the first rotational direction, the recording sheet 12 is conveyed in the direction opposite to the first direction 15 so as to enter into the second conveyance path 67.

The second conveyance path 67 is branched off from the first conveyance path 65 at the branch portion 36 so as to be merged with the first conveyance path 65 at a meeting portion 37 located upstream of the first conveyor roller 60 in the first direction 15. That is, the second conveyance path 67 is connected to the first conveyance path 65 at the branch portion 36 and the meeting portion 37. The second conveyance path 67 is defined by guide members 31, 32.

Fourth Conveyor Rollers 68

As illustrated in FIG. 2, fourth conveyor rollers 68 and driven rollers 69 are provided in the second conveyance path 67. The fourth conveyor rollers 68 are disposed in the second conveyance path 67 at positions under and opposite to the driven rollers 69.

The driving power of the conveyor motor 71 is transmitted to the fourth conveyor rollers 68 via a fourth power transmitter 28 of the drive-power transmitting mechanism 50 which will be described below. Upon receipt of the driving power, the fourth conveyor rollers 68 are rotated in such a direction that the recording sheet 12 is conveyed in a second direction 16 along the second conveyance path 67. Specifically, the fourth conveyor rollers 68 are rotated only in the first rotational direction. Here, the second direction 16 is a direction directed from the branch portion 36 toward the meeting portion 37 along the second conveyance path 67. This second direction 16 is indicated by two-dot chain-line arrow in FIG. 2.

In view of the above, when the recording sheet 12 conveyed into the second conveyance path 67 by the third conveyor rollers 45 is nipped between the fourth conveyor rollers 68 and the driven roller 69, the recording sheet 12 is conveyed by the fourth conveyor rollers 68 in the second direction 16. As a result, the recording sheet 12 is conveyed to a position upstream of the first conveyor roller 60 in the first direction 15. Power transmission from the conveyor motor 71 to the fourth conveyor rollers 68 will be explained later.

Drive-Power Transmitting Mechanism 50

Figure 3:
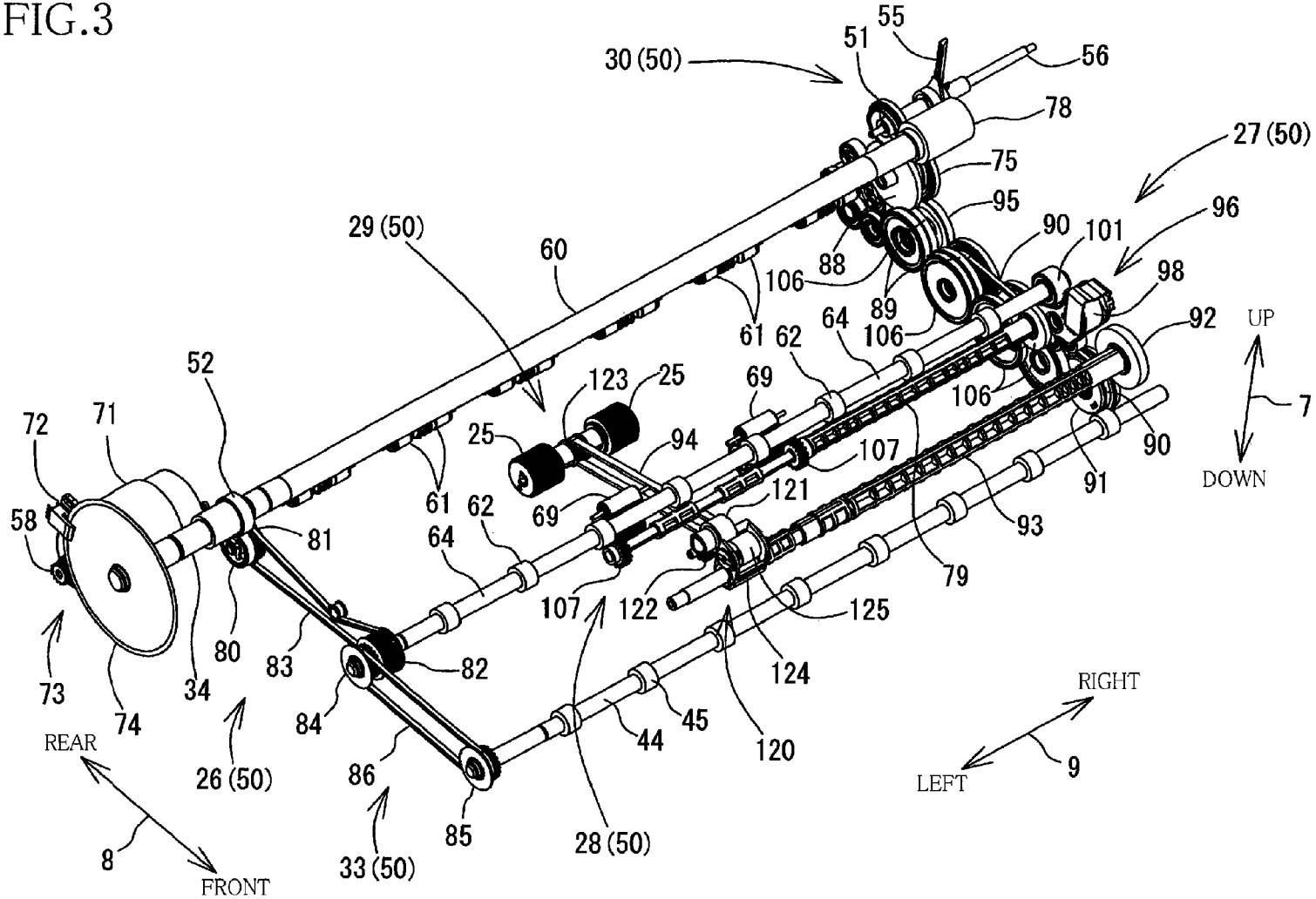
FIG. 3 is a perspective view illustrating a drive-power transmitting mechanism 50 and conveyor rollers 60, 62, 45.
Figure 4:
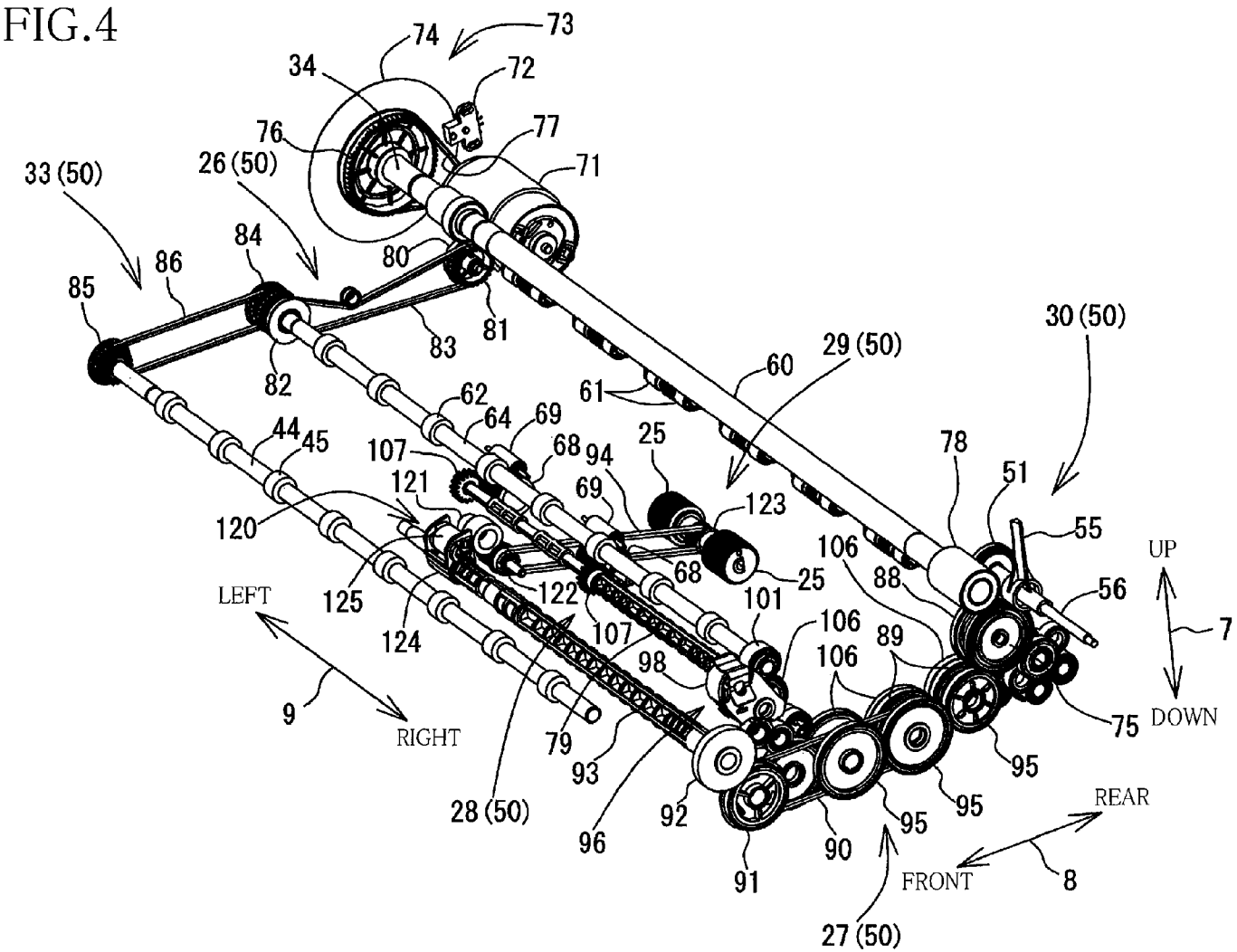
FIG. 4 is a perspective view illustrating the drive-power transmitting mechanism 50 and the conveyor rollers 60, 62, 45.
Figure 5:
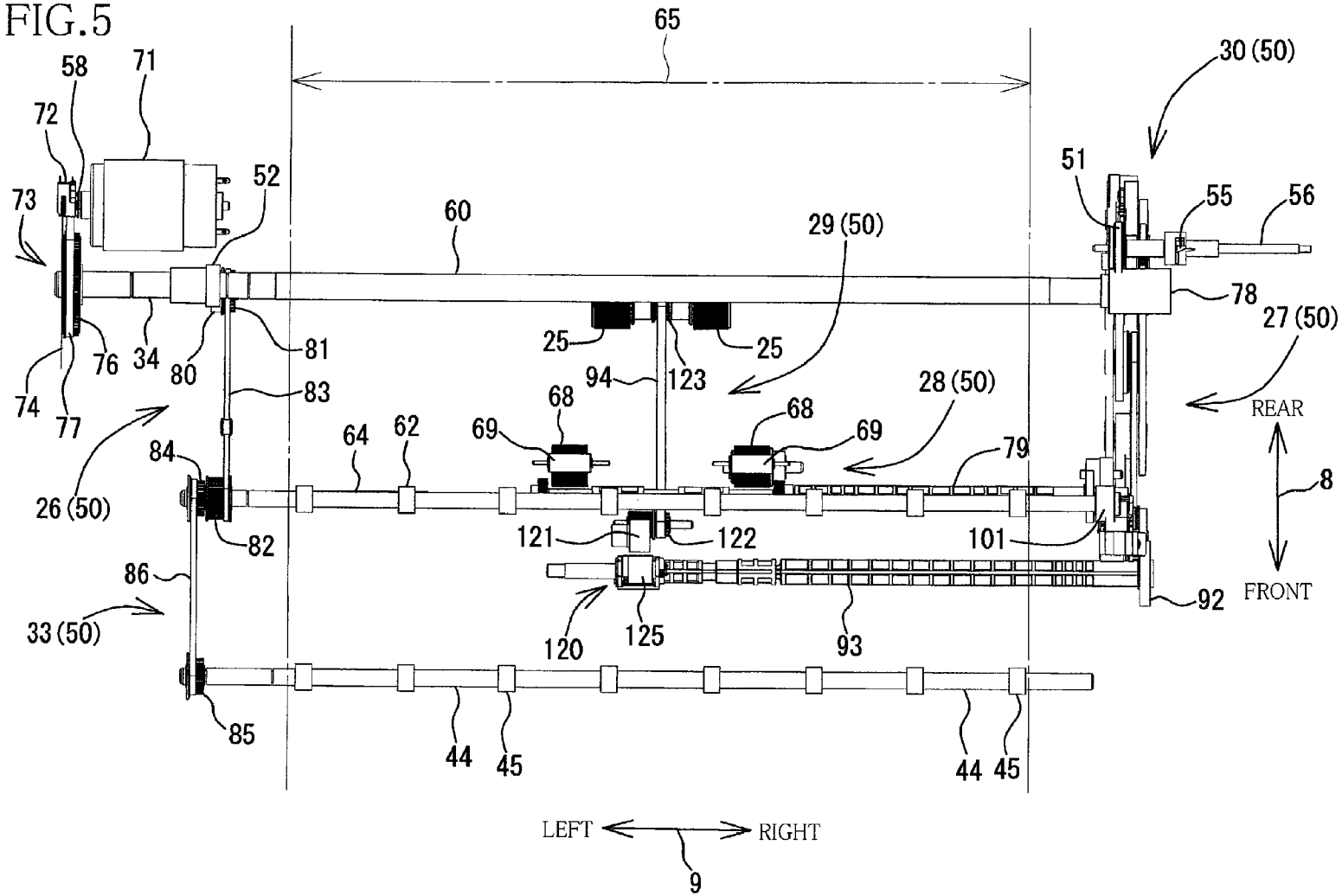
FIG. 5 is a plan view illustrating the drive-power transmitting mechanism 50 and the conveyor rollers 60, 62, 45.

As illustrated in FIGS. 3-5, the printing section 11 is provided with the drive-power transmitting mechanism 50. The drive-power transmitting mechanism 50 includes a roller pulley 76, a motor pulley 58, a first belt 77, a first power transmitter 26, a second power transmitter 27, a third power transmitter 33, the fourth power transmitter 28, a supply power transmitter 29, and a switcher 30. In the present embodiment, the second power transmitter 27 and the third power transmitter 33 are one example of a second power transmitter.

The drive-power transmitting mechanism 50 causes the rollers 60, 62, 45, 68, 25 to be rotated so as to convey the recording sheet 12 in their respective directions described in FIG. 8. That is, the drive-power transmitting mechanism 50 causes the rollers 60, 62, 45, 68, 25 to be rotated depending upon a position of a switch gear 51 (as one example of a first gear) of the switcher 30 and the rotational direction of the conveyor motor 71. The rollers 60, 62, 45, 68, 25 are rotated by the drive power transmitted from the conveyor motor 71 via any of the first power transmitter 26, the second power transmitter 27, the third power transmitter 33, the fourth power transmitter 28, and the supply power transmitter 29. It is noted that in FIG. 8 each of the rollers 60, 62, 45, 68, 25 receives the rotational driving power from the conveyor motor 71 via a transmitter whose name is described in corresponding parentheses.

As illustrated in FIG. 5, the roller pulley 76 is mounted on the shaft 34 of the first conveyor roller 60 on a left side of the first conveyance path 65. As illustrated in FIGS. 3-5, the motor pulley 58 is mounted on a rotation shaft of the conveyor motor 71. The endless first belt 77 is looped over the roller pulley 76 and the motor pulley 58. As a result, the rotational driving power of the conveyor motor 71 is transmitted to the first conveyor roller 60. Specifically, when the conveyor motor 71 is rotated in the forward direction, the first conveyor roller 60 is rotated in the first rotational direction, and when the conveyor motor 71 is rotated in the reverse direction, the first conveyor roller 60 is rotated in the second rotational direction.

First Power Transmitter 26

As illustrated in FIGS. 3-6, the first power transmitter 26 includes a left gear 52, a lower gear 80, a first pulley 81, a second pulley 82, and a second belt 83. The left gear 52 is mounted on the shaft 34 of the first conveyor roller 60 on a left side of the first conveyance path 65. The lower gear 80 is provided under the left gear 52 so as to be in meshed engagement with the left gear 52. The first pulley 81 is mounted on a right face of the lower gear 80 so as to be rotated coaxially and together with the lower gear 80. As a result, the first pulley 81 is rotated along with the rotation of the first conveyor roller 60. The second pulley 82 is mounted on a shaft 64 of the second conveyor rollers 62. The endless second belt 83 is looped over the first pulley 81 and the second pulley 82. As a result, the rotation of the first conveyor roller 60 rotates the second belt 83, causing the rotational driving power of the first conveyor roller 60 to be transmitted to the second conveyor rollers 62.

Third Power Transmitter 33

As illustrated in FIGS. 3-6, the third power transmitter 33 includes a third pulley 84, a fourth pulley 85, and a third belt 86. The third pulley 84 is mounted on the shaft 64 on a left side of the second pulley 82 so as to be rotated coaxially and together with the second pulley 82. The fourth pulley 85 is mounted on a shaft 44 of the third conveyor rollers 45. The endless third belt 86 is looped over the third pulley 84 and the fourth pulley 85. As a result, the rotational driving power of the second conveyor rollers 62 is transmitted to the third conveyor rollers 45. That is, the third conveyor rollers 45 are rotated with the rotation of the second conveyor rollers 62 by receiving the rotational driving power from the second conveyor rollers 62.

In the following explanation, each of the clockwise direction and the counterclockwise direction is a rotational direction of each roller and each gear in FIG. 6. That is, each of the clockwise direction and the counterclockwise direction is a rotational direction of each roller and each gear when each roller and each gear are seen from the left side. Accordingly, it is to be understood that, when each roller and each gear are seen from the right side, for example, the clockwise direction and the counterclockwise direction respectively coincide with the counterclockwise direction and the clockwise direction when each roller and each gear are seen from the left side.

A well-known one-way clutch (specifically, a needle clutch) is provided inside the second pulley 82. That is, the second pulley 82 is mounted on the shaft 64 via the one-way clutch. As a result, as illustrated in FIG. 6, in the present embodiment, when the conveyor motor 71 is rotated in the forward direction, the shaft 64 is rotated in the clockwise direction, i.e., the second rotational direction, but when the conveyor motor 71 is rotated in the reverse direction, the shaft 64 is not rotated. Accordingly, when the conveyor motor 71 is rotated in the forward direction, the forward rotational driving power is transmitted to the conveyor rollers 60, 62, 45, causing the conveyor rollers 60, 62, 45 to be rotated so as to convey the recording sheet 12 in the first direction 15. Specifically, in the present embodiment, the first conveyor roller 60 is rotated in the counterclockwise direction, i.e., the first rotational direction, and each of the second conveyor rollers 62 and the third conveyor rollers 45 is rotated in the clockwise direction, i.e., the second rotational direction. On the other hand, when the conveyor motor 71 is rotated in the reverse direction, the reverse rotational driving power is transmitted to the first conveyor roller 60, but the second pulley 82 slips on the shaft 64 by the one-way clutch. Thus, the reverse rotational driving power is not transmitted to the second conveyor rollers 62. As a result, only the first conveyor roller 60 is rotated in the clockwise direction, i.e., the second rotational direction so as to convey the recording sheet 12 in the direction opposite to the first direction 15, and the second conveyor rollers 62 and the third conveyor rollers 45 are not rotated.

Second Power Transmitter 27

As illustrated in FIGS. 3-6, the second power transmitter 27 includes: a first transmission gear 78; a first output gear 75 (as one example of a second gear), a plurality of first intermediate gears 95 meshed with one another; a second transmission gear 101 (as one example of a driving gear mechanism); and a first planetary gear mechanism 96 (as one example of a planetary gear mechanism). The first planetary gear mechanism 96 includes: a sun gear 97 meshed with a frontmost one of the first intermediate gears 95; a planetary gear 98 rotatable while revolving around the sun gear 97; and an arm 102. It is noted that, in the present embodiment, the above-described third power transmitter 33 is also one example of the driving gear mechanism in addition to the second transmission gear 101.

The first transmission gear 78 is provided on the shaft 34 of the first conveyor roller 60 on a right side of the first conveyance path 65. When the first conveyor roller 60 is rotated, the first transmission gear 78 is also rotated. That is, the first transmission gear 78 is provided coaxially with the first conveyor roller 60 and rotated together with the first conveyor roller 60. As a result, the rotational driving power is transmitted from the first transmission gear 78 to the first output gear 75 via the switch gear 51 of the switcher 30 which will be described below.

The first output gear 75 is in meshed engagement with: the switch gear 51; a rearmost one of the first intermediate gears 95; and a sun gear 109 of a second planetary gear mechanism 103 of the fourth power transmitter 28 which will be described below. It is noted that, as will be described below, when the switch gear 51 is located at a second power transmission position, the first output gear 75 is meshed with the switch gear 51, so that the rotational driving power is transmitted from the first transmission gear 78 to the first output gear 75 (see FIG. 7B).

The first intermediate gears 95 are arranged substantially in the front and rear directions 8 in a state in which the first intermediate gears 95 are meshed with one another. In the present embodiment, an even number of the first intermediate gears 95 are arranged. It is to be understood that, while the four first intermediate gears 95 are illustrated in FIG. 6, the number of the first intermediate gears 95 is not limited to four. The frontmost first intermediate gear 95 is meshed with the sun gear 97 of the first planetary gear mechanism 96. In view of the above, the rotational driving power of the first transmission gear 78 is transmitted to the sun gear 97 via the first output gear 75 and the first intermediate gears 95.

The sun gear 97 is rotatably supported by, e.g., the frame of the printing section 11. The sun gear 97 has a thrust face on which one end of the arm 102 is mounted. As a result, the arm 102 is rotated coaxially with the sun gear 97. The planetary gear 98 is rotatably supported on the other end of the arm 102. The planetary gear 98 is in meshed engagement with the sun gear 97. Thus, the planetary gear 98 is rotated while supported by the arm 102 and is revolved in a rotational direction of the sun gear 97 while meshed with the sun gear 97.

Figure 6:
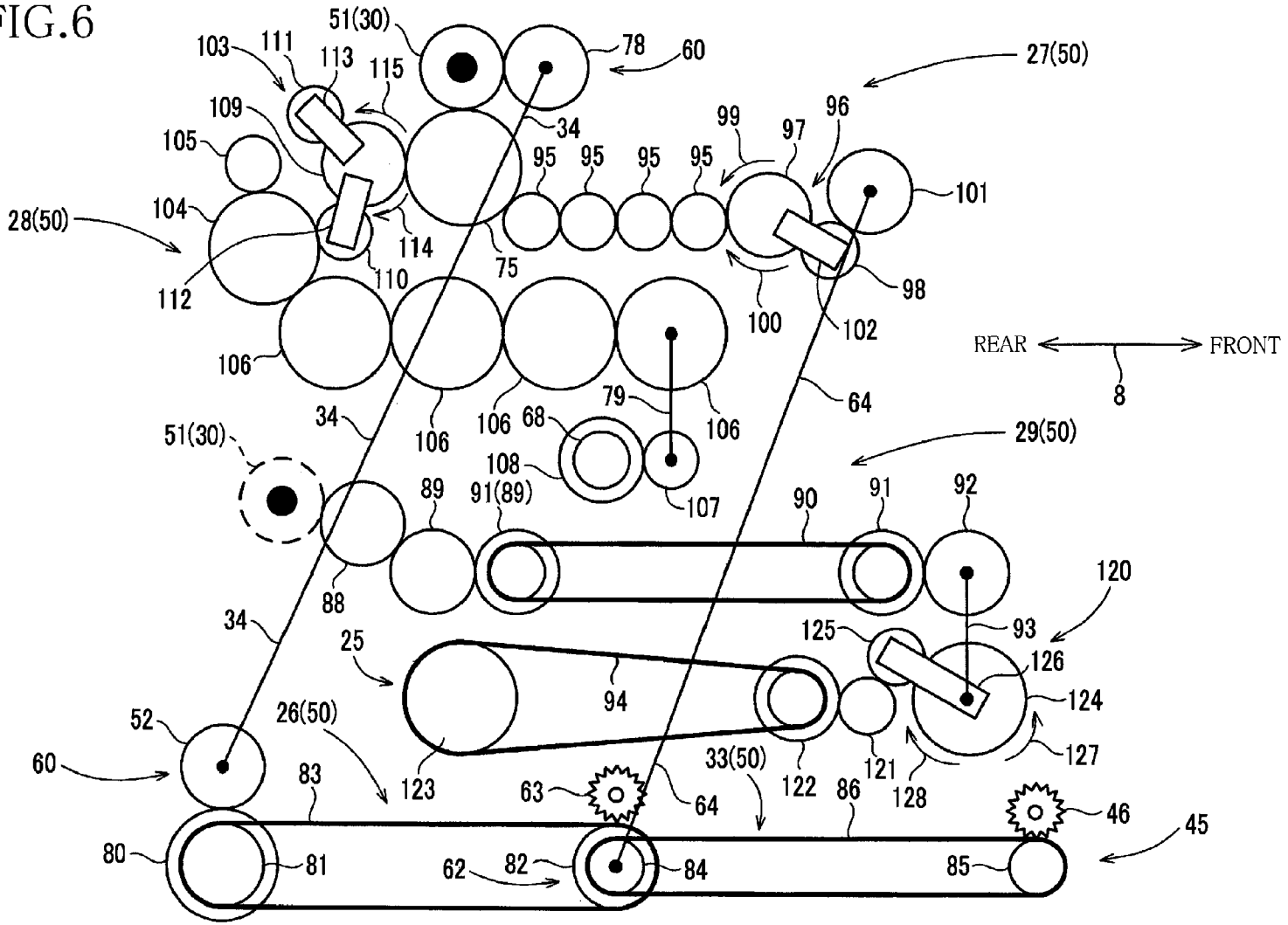
FIG. 6 is a schematic view illustrating a power-transmission relationship among rollers, belts, gears, and pulleys of the drive-power transmitting mechanism 50.

There will be next explained power transmission of the second power transmitter 27 with reference to FIG. 6. When the conveyor motor 71 (see FIGS. 3-5) is rotated in the reverse direction, each of the first conveyor roller 60 and the first transmission gear 78 is rotated in the clockwise direction, i.e., the second rotational direction. Here, the switch gear 51, the first output gear 75, and the even number of the first intermediate gears 95 are provided between the first transmission gear 78 and the sun gear 97, that is, an even number of gears are arranged in series between the first transmission gear 78 and the sun gear 97 in a state in which these gears are meshed with one another. Thus, when the first transmission gear 78 is rotated in the clockwise direction, the sun gear 97 is rotated in the counterclockwise direction, i.e., in a direction indicated by arrow 99 (as one example of a third rotational direction).

When the sun gear 97 is rotated in the counterclockwise direction, the planetary gear 98 is revolved around the sun gear 97 in the direction indicated by arrow 99. As a result, the planetary gear 98 is connected to and meshed with the second transmission gear 101. Here, the second transmission gear 101 is provided on a right end portion of the shaft 64 of the second conveyor rollers 62 (see FIGS. 3-5) and rotated together with the second conveyor rollers 62. When the planetary gear 98 and the second transmission gear 101 are connected to and meshed with each other (that is, a connected state is established), the planetary gear 98 stops revolving and starts rotating. A direction of the rotation of the planetary gear 98 is the clockwise direction. Thus, when the planetary gear 98 is rotated, the second transmission gear 101 connected to and meshed with the planetary gear 98, i.e., the second conveyor rollers 62 are rotated in the counterclockwise direction, i.e., the first rotational direction, that is, the second conveyor rollers 62 are rotated in the direction in which the recording sheet 12 is conveyed in the direction opposite to the first direction 15.

The rotational driving power of the second conveyor rollers 62 in the counterclockwise direction, i.e., the first rotational direction is transmitted to the third conveyor rollers 45 via the third pulley 84, the third belt 86, and the fourth pulley 85. As a result, the third conveyor rollers 45 are also rotated in the counterclockwise direction, i.e., the first rotational direction, that is, the third conveyor rollers 45 are also rotated in the direction in which the recording sheet 12 is conveyed in the direction opposite to the first direction 15.

On the other hand, in contrast to the above-described case, when the conveyor motor 71 is rotated in the forward direction, the first transmission gear 78 is rotated in the counterclockwise direction, i.e., the first rotational direction, and the sun gear 97 having received the rotational driving power from the first transmission gear 78 is rotated in the clockwise direction, i.e., in a direction indicated by arrow 100 (as one example of a fourth rotational direction). Thus, the planetary gear 98 is revolved around the sun gear 97 in the direction indicated by arrow 100. As a result, the planetary gear 98 is disconnected from the second transmission gear 101 (that is, a separated state is established). Thus, the second power transmitter 27 does not cause the rotations of the second conveyor rollers 62 and the third conveyor rollers 45.

In view of the above, the second power transmitter 27 transmits the rotational driving power of the first conveyor roller 60 in the second rotational direction (as one example of a second rotational driving power) to the second conveyor rollers 62. On the other hand, the second power transmitter 27 does not transmit the rotational driving power of the first conveyor roller 60 in the first rotational direction (as one example of a first rotational driving power) to the second conveyor rollers 62.

It is noted that, when the conveyor motor 71 is rotated in the forward direction, the forward rotational driving power of the conveyor motor 71 is transmitted to the second conveyor rollers 62 by the first power transmitter 26 and to the third conveyor rollers 45 by the third power transmitter 33 as described above. Thus, when the conveyor motor 71 is rotated in the forward direction, the conveyor rollers 60, 62, 45 are rotated so as to convey the recording sheet 12 in the first direction 15. That is, the first conveyor roller 60 is rotated in the counterclockwise direction, i.e., the first rotational direction, and the second conveyor rollers 62 and the third conveyor rollers 45 are rotated in the clockwise direction, i.e., the second rotational direction.

Fourth Power Transmitter 28

As illustrated in FIGS. 3-6, the fourth power transmitter 28 includes: the second planetary gear mechanism 103; a forward-rotation meshing gear 104; a reverse-rotation meshing gear 105; a plurality of second intermediate gears 106 meshed with one another; third intermediate gears 107; and a third gear 108. The second planetary gear mechanism 103 includes: the sun gear 109 meshed with the first output gear 75; two planetary gears 110, 111 each rotatable while revolving around the sun gear 109; and two arms 112, 113.

The sun gear 109 is rotatably supported by, e.g., the frame of the printing section 11. The sun gear 109 is rotated by the driving power transmitted from the first output gear 75 of the second power transmitter 27. That is, as in the case of the second power transmitter 27, the fourth power transmitter 28 receives the driving power from the first transmission gear 78 when the switch gear 51 is located at the second power transmission position (see FIG. 7B).

The sun gear 109 has a thrust face on which one ends of the arms 112, 113 are mounted. Thus, the arms 112, 113 are rotated coaxially with the sun gear 109. The planetary gear 110 is rotatably supported on the other end of the arm 112. The planetary gear 111 is rotatably supported on the other end of the arm 113. The planetary gears 110, 111 are in meshed engagement with the sun gear 109. In the construction described above, the planetary gear 110 is rotated while supported by the arm 112 and is revolved in a rotational direction of the sun gear 109 while meshed with the sun gear 109. Also, the planetary gear 111 is rotated while supported by the arm 113 and is revolved in a rotational direction of the sun gear 109 while meshed with the sun gear 109.

The planetary gear 110 is meshable with the forward-rotation meshing gear 104. The planetary gear 111 is meshable with the reverse-rotation meshing gear 105. The reverse-rotation meshing gear 105 is in meshed engagement with the forward-rotation meshing gear 104. In addition to the reverse-rotation meshing gear 105, the forward-rotation meshing gear 104 is in meshed engagement with a rearmost one of the second intermediate gears 106.

The second intermediate gears 106 are arranged substantially in the front and rear directions 8 in a state in which the second intermediate gears 106 are meshed with one another. In the present embodiment, an even number of the second intermediate gears 106 are arranged. It is to be understood that, while the four second intermediate gears 106 are illustrated in FIG. 6, the number of the second intermediate gears 106 is not limited to four. The third intermediate gears 107 are provided coaxially with a frontmost one of the second intermediate gears 106. The third intermediate gears 107 are rotated about a shaft 79 together with the frontmost second intermediate gear 106. The third intermediate gears 107 are in meshed engagement with the third gear 108. The third gear 108 is disposed coaxially with the fourth conveyor rollers 68 so as to be rotatable together with the fourth conveyor rollers 68.

There will be next explained power transmission of the fourth power transmitter 28 with reference to FIG. 6. When the conveyor motor 71 is rotated in the forward direction, the first conveyor roller 60 and the first transmission gear 78 are rotated in the counterclockwise direction, i.e., the first rotational direction, the switch gear 51 is rotated in the clockwise direction, and the first output gear 75 is rotated in the counterclockwise direction. The sun gear 109 is in turn rotated in the clockwise direction, i.e., in a direction indicated by arrow 114. As a result, the arms 112, 113 are also rotated in the direction indicated by arrow 114. Thus, the planetary gear 110 is meshed with the forward-rotation meshing gear 104, and the planetary gear 111 is disconnected or moved away from the reverse-rotation meshing gear 105. The planetary gear 111 meshed with the forward-rotation meshing gear 104 is rotated in the counterclockwise direction, whereby the forward-rotation meshing gear 104 is rotated in the clockwise direction.

Here, the even number of the second intermediate gears 106 are arranged in series between the forward-rotation meshing gear 104 and the third gear 108 in a state in which these gears are meshed with one another. It is noted that since the third intermediate gears 107 are rotated coaxially and together with the second intermediate gears 106, the number of the third intermediate gears 107 is not included in the above-described number of the second intermediate gears 106. In view of the above, when the forward-rotation meshing gear 104 is rotated in the clockwise direction, the third gear 108 and the fourth conveyor rollers 68 are rotated in the counterclockwise direction. That is, when the conveyor motor 71 is rotated in the forward direction, the fourth conveyor rollers 68 are rotated in the counterclockwise direction, i.e., the first rotational direction.

On the other hand, when the conveyor motor 71 is rotated in the reverse direction, each of the first conveyor roller 60 and the first transmission gear 78 is rotated in the clockwise direction, i.e., the second rotational direction, the switch gear 51 is rotated in the counterclockwise direction, and the first output gear 75 is rotated in the clockwise direction. The sun gear 109 is in turn rotated in the counterclockwise direction, i.e., in a direction indicated by arrow 115. As a result, the arms 112, 113 are also rotated in the direction indicated by arrow 115. Thus, the planetary gear 110 is disconnected or moved away from the forward-rotation meshing gear 104, and the planetary gear 111 is meshed with the reverse-rotation meshing gear 105. The planetary gear 111 meshed with the reverse-rotation meshing gear 105 is rotated in the clockwise direction, whereby the reverse-rotation meshing gear 105 is rotated in the counterclockwise direction.

Here, the forward-rotation meshing gear 104 and the even number of the second intermediate gears 106 are arranged between the reverse-rotation meshing gear 105 and the third gear 108, that is, an odd number of gears are arranged in series between the reverse-rotation meshing gear 105 and the third gear 108 in a state in which these gears are meshed with one another. In view of the above, when the reverse-rotation meshing gear 105 is rotated in the counterclockwise direction, the third gear 108 and the fourth conveyor rollers 68 are also rotated in the counterclockwise direction. That is, even when the conveyor motor 71 is rotated in the reverse direction, the fourth conveyor rollers 68 are rotated in the counterclockwise direction, i.e., the first rotational direction.

In view of the above, the fourth power transmitter 28 transmits the forward and reverse rotational driving powers of the first conveyor roller 60, i.e., both of the first rotational driving power and the reverse rotational driving power, to the fourth conveyor rollers 68 as the rotational driving power for conveying the recording sheet 12 in the second direction 16, i.e., the rotational driving power in the first rotational direction.

Supply Power Transmitter 29

As illustrated in FIGS. 3-6, the supply power transmitter 29 includes: a second output gear 88; fourth intermediate gears 89; a fourth belt 90; two fifth intermediate gears 91; a sixth intermediate gear 92 mounted on a shaft 93; a third planetary gear mechanism 120; a seventh intermediate gear 121; an eighth intermediate gear 122; a fifth belt 94; and a supply pulley 123 provided coaxially with the supply rollers 25. The third planetary gear mechanism 120 includes: a sun gear 124 rotatable about and together with the shaft 93; a planetary gear 125 rotatable while revolving around the sun gear 124; and an arm 126.

The second output gear 88 is in meshed engagement with a rear one of the fourth intermediate gears 89. As will be described below, when the switch gear 51 is located at a first power transmission position, the second output gear 88 is meshed with the switch gear 51, so that the rotational driving power is transmitted from the first transmission gear 78 to the second output gear 88 (see FIG. 7A). In the present embodiment, an even number of the fourth intermediate gears 89 (specifically, two fourth intermediate gears 89) are provided. A front one of the fourth intermediate gears 89 is disposed coaxially with a rear one of the two fifth intermediate gears 91.

The endless fourth belt 90 is looped over the two fifth intermediate gears 91. Specifically, the fourth belt 90 is disposed adjacent to the two fifth intermediate gears 91 and looped over two pulleys that are respectively rotated coaxially and together with the fifth intermediate gears 91.

A front one of the two fifth intermediate gears 91 is in meshed engagement with the sixth intermediate gear 92. The sixth intermediate gear 92 and the sun gear 124 of the third planetary gear mechanism 120 are rotated about and together with the shaft 93. The sun gear 124 has a thrust face on which one end of the arm 126 is mounted. Thus, the arm 126 is rotated about the shaft 93. The planetary gear 125 is rotatably supported on the other end of the arm 126. The planetary gear 125 is in meshed engagement with the sun gear 124. In the construction described above, the planetary gear 125 is rotated while supported by the arm 126 and is revolved around the sun gear 124 in a rotational direction of the sun gear 124 while meshed with the sun gear 124.

The seventh intermediate gear 121 is disposed at a position at which the seventh intermediate gear 121 is meshable with the planetary gear 125. The eighth intermediate gear 122 is in meshed engagement with the seventh intermediate gear 121. The endless fifth belt 94 is looped over the supply pulley 123 and the eighth intermediate gear 122 (specifically, a pulley disposed adjacent to the eighth intermediate gear 122 and rotatable coaxially and together with the eighth intermediate gear 122). It is noted that the supply rollers 25 and the supply pulley 123 are rotated coaxially and together with each other.

There will be next explained power transmission of the supply power transmitter 29 with reference to FIG. 6. When the conveyor motor 71 is rotated in the reverse direction, each of the first conveyor roller 60 and the first transmission gear 78 is rotated in the clockwise direction, i.e., the second rotational direction. When the first transmission gear 78 is rotated in the clockwise direction, the switch gear 51 is rotated in the counterclockwise direction, the second output gear 88 is rotated in the clockwise direction, the fourth intermediate gears 89 are rotated in the counterclockwise direction, and the two fifth intermediate gears 91 are rotated in the clockwise direction.

When the fifth intermediate gears 91 are rotated in the clockwise direction, the sixth intermediate gear 92 and the sun gear 124 provided coaxially with the sixth intermediate gear 92 are rotated in the counterclockwise direction. When the sun gear 124 is rotated in the counterclockwise direction, i.e., in a direction indicated by arrow 127, the planetary gear 125 is revolved around the sun gear 124 in the direction indicated by arrow 127. As a result, the planetary gear 125 is connected to and meshed with the seventh intermediate gear 121. When the planetary gear 125 and the seventh intermediate gear 121 are connected to and meshed with each other, the planetary gear 125 stops revolving and starts rotating. A direction of the rotation of the planetary gear 125 is the clockwise direction. Thus, when the planetary gear 125 is rotated, the seventh intermediate gear 121 meshed with the planetary gear 125 is rotated in the counterclockwise direction.

When the seventh intermediate gear 121 is rotated in the counterclockwise direction, the eighth intermediate gear 122 and the supply pulley 123 are rotated in the clockwise direction. When the supply pulley 123 is rotated in the clockwise direction, the supply rollers 25 are also rotated in the clockwise direction, i.e., the second rotational direction. When the supply rollers 25 are rotated in the clockwise direction, i.e., the second rotational direction, the recording sheet 12 placed on the supply tray 20 and contacting the supply rollers 25, i.e., an uppermost one of the recording sheets 12 placed on the supply tray 20 is supplied toward the first conveyor roller 60.

On the other hand, when the conveyor motor 71 is rotated in the forward direction, the sun gear 124 is rotated in the clockwise direction, i.e., in a direction indicated by arrow 128 in contrast to the case where the conveyor motor 71 is rotated in the reverse direction. Thus, the planetary gear 125 is revolved around the sun gear 124 in the direction indicated by arrow 128. As a result, the planetary gear 125 is disconnected or moved away from the seventh intermediate gear 121. In view of the above, when the conveyor motor 71 is rotated in the forward direction, the rotational driving power is not transmitted from the conveyor motor 71 to the supply rollers 25, not causing the rotation of the supply rollers 25.

Switcher 30

As illustrated in FIGS. 3-7B, the switcher 30 includes the switch gear 51, coil springs 56, 57, and a switch lever 55.

Figure 7B:
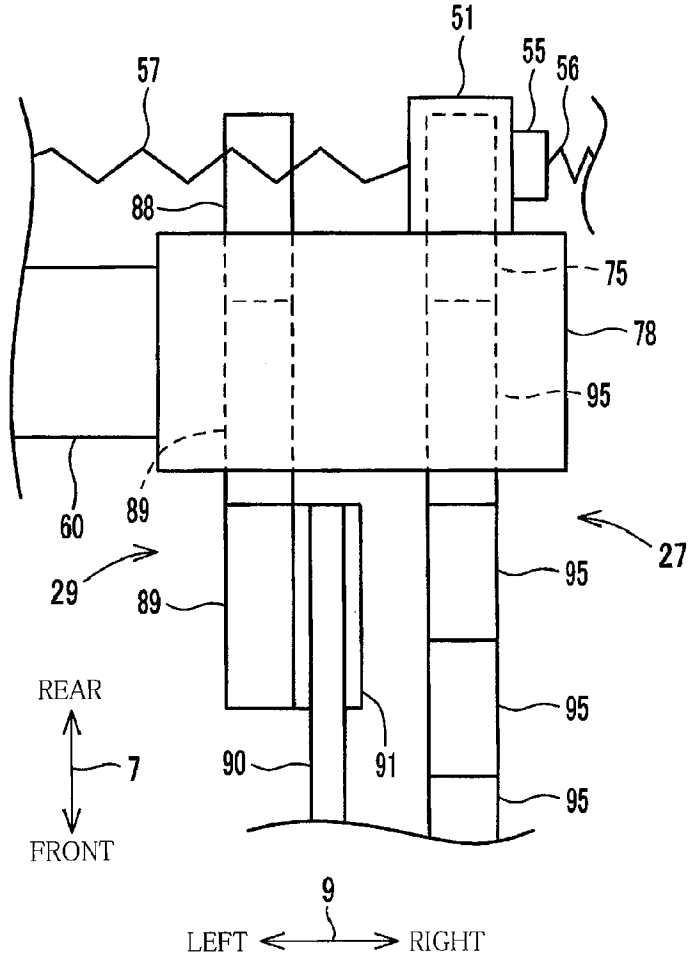
FIG. 7B is a plan view schematically illustrating the meshing states of gears 51, 75, 78, 88 with the switch gear 51 located at a second power transmission position.
Figure 7A:
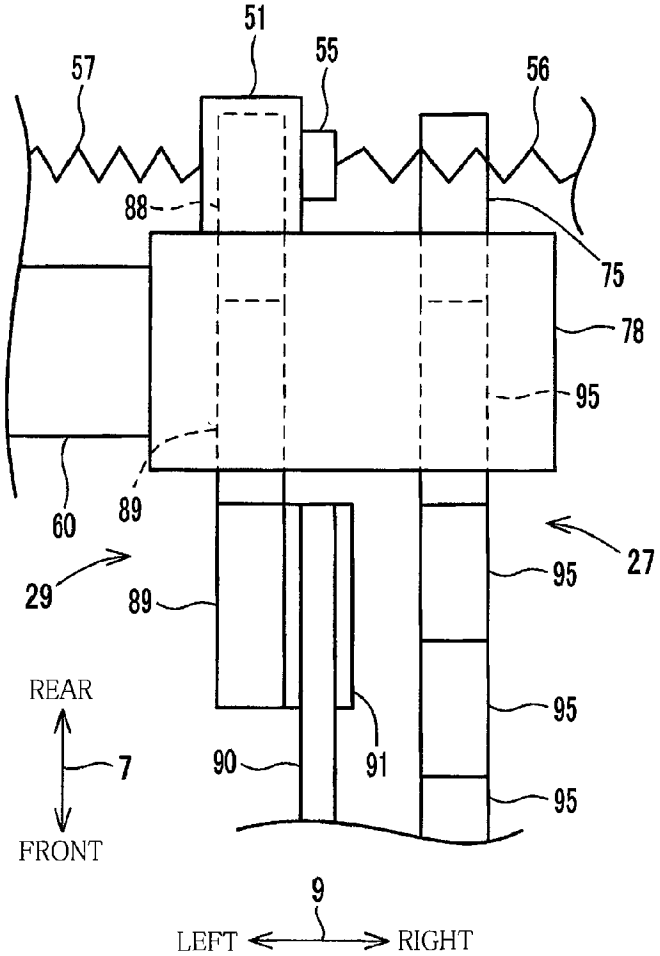
FIG. 7A is a plan view schematically illustrating meshing states of gears 51, 75, 78, 88 with a switch gear 51 located at a first power transmission position.

As illustrated in FIGS. 7A and 7B, the switch gear 51 is in meshed engagement with the first transmission gear 78. Thus, the switch gear 51 is rotated by the driving power transmitted from the conveyor motor 71. The switch gear 51 is movable in the right and left directions 9 at least between the first power transmission position (as one example of a first position) indicated in FIG. 7A and the second power transmission position (as one example of a second position) indicated in FIG. 7B in a state in which the switch gear 51 is meshed with the first transmission gear 78. The first power transmission position is located on a left side of the second power transmission position. Each of the first power transmission position and the second power transmission position is located on a right side of the first conveyance path 65.

As illustrated in FIG. 7A, when the switch gear 51 is located at the first power transmission position, the switch gear 51 is connected to (i.e., meshed with) the first transmission gear 78 and the second output gear 88. It is noted that the switch gear 51 is not meshed with the first output gear 75 in this state. As a result, the rotational driving power transmitted from the conveyor motor 71 to the switch gear 51 via the first transmission gear 78 is transmitted to the supply power transmitter 29.

As illustrated in FIG. 7B, when the switch gear 51 is located at the second power transmission position, the switch gear 51 is connected to (i.e., meshed with) the first transmission gear 78 and the first output gear 75. It is noted that the switch gear 51 is not meshed with the second output gear 88 in this state. As a result, the rotational driving power transmitted from the conveyor motor 71 to the switch gear 51 via the first transmission gear 78 is transmitted to the second power transmitter 27 and the fourth power transmitter 28.

As illustrated in FIGS. 7A and 7B, a right face of the switch gear 51 is contactable with the switch lever 55. The carriage 40 of the recording portion 24 is contactable with the switch lever 55 from the left side. Also, the switch lever 55 is provided with the coil spring 56. The switch lever 55 and the coil spring 56 are arranged along an axial direction of the switch gear 51. One end of the coil spring 56 is mounted on a right face of the switch lever 55, and the other end of the coil spring 56 is mounted on, e.g., the frame of the printing section 11, not shown. As a result, the switch lever 55 is urged by the coil spring 56 from a side nearer to the second power transmission position toward a side nearer to the first power transmission position, i.e., in a left direction. Also, the coil spring 57 is mounted on the switch gear 51 on an opposite side thereof from the coil spring 56. As a result, the switch gear 51 is urged by the coil spring 57 from the side nearer to the first power transmission position toward the side nearer to the second power transmission position, i.e., in a right direction. It is noted that an urging force of the coil spring 56 is greater than that of the coil spring 57. Therefore, the switch gear 51 and the switch lever 55 are urged from the side nearer to the second power transmission position toward the side nearer to the first power transmission position, i.e., in the left direction.

The switch gear 51 located at the first power transmission position is inhibited by a stopper, not shown, from being moved by the urging force of the coil spring 56 from the second power transmission position toward the first power transmission position, i.e., in the left direction. This keeps the switch gear 51 at the first power transmission position. When the switch gear 51 located at the first power transmission position is pushed by the carriage 40 so as to be moved rightward from the first power transmission position, the switch gear 51 is moved from the first power transmission position (see FIG. 7A) to the second power transmission position (see FIG. 7B). It is noted that the stopper is designed to inhibit or stop the leftward movement of the switch gear 51 at the first power transmission position and the second power transmission position but also designed not to inhibit or stop the rightward movement of the switch gear 51 at the first power transmission position and the second power transmission position.

As in the case of the switch gear 51 located at the first power transmission position, the switch gear 51 located at the second power transmission position is inhibited by a stopper, not shown, (having a construction similar to that of the stopper provided at the first power transmission position) from being moved by the urging force of the coil spring 56 from the second power transmission position toward the first power transmission position, i.e., in the leftward direction. This keeps the switch gear 51 at the second power transmission position.

When the switch gear 51 located at the second power transmission position is pushed by the carriage 40 so as to be moved rightward from the second power transmission position, the switch gear 51 is released from the stopper. When the carriage 40 is moved leftward in this state, the switch gear 51 is moved by the urging force of the coil spring 56 from the second power transmission position to the first power transmission position.

In view of the above, the switcher 30 selectively switches a destination of the power transmission from the first conveyor roller 60, to the second power transmitter 27 and the fourth power transmitter 28, or the supply power transmitter 29. Specifically, when the switch gear 51 is located at the second power transmission position, the switcher 30 transmits the driving power from the first conveyor roller 60 to the second power transmitter 27 and the fourth power transmitter 28. On the other hand, when the switch gear 51 is located at the first power transmission position, the switcher 30 does not transmit the driving power from the first conveyor roller 60 to the second power transmitter 27. It is noted that, when the switch gear 51 is located at the first power transmission position, the switcher 30 transmits the driving power from the first conveyor roller 60 to the supply power transmitter 29.

Forward and Reverse Rotations of Switch Gear 51 for Gear Switching

In the construction as described above, teeth of gears are sometimes not aligned when the switch gear 51 is meshed with the first output gear 75 by the movement of the switch gear 51 from the first power transmission position to the second power transmission position, or when the switch gear 51 is disengaged from the first output gear 75 and meshed with the second output gear 88 by the movement of the switch gear 51 from the second power transmission position to the first power transmission position. Specifically, a tooth of one of the gears may not enter into a position between teeth of the other of the gears, that is, thrust faces of the teeth of the other gear inhibit movement of the tooth of the one gear. In this case, the switch gear 51 may not be engaged with the gear 75 or 88. That is, switching of the switch gear 51 may not be performed appropriately.

Figure 10:
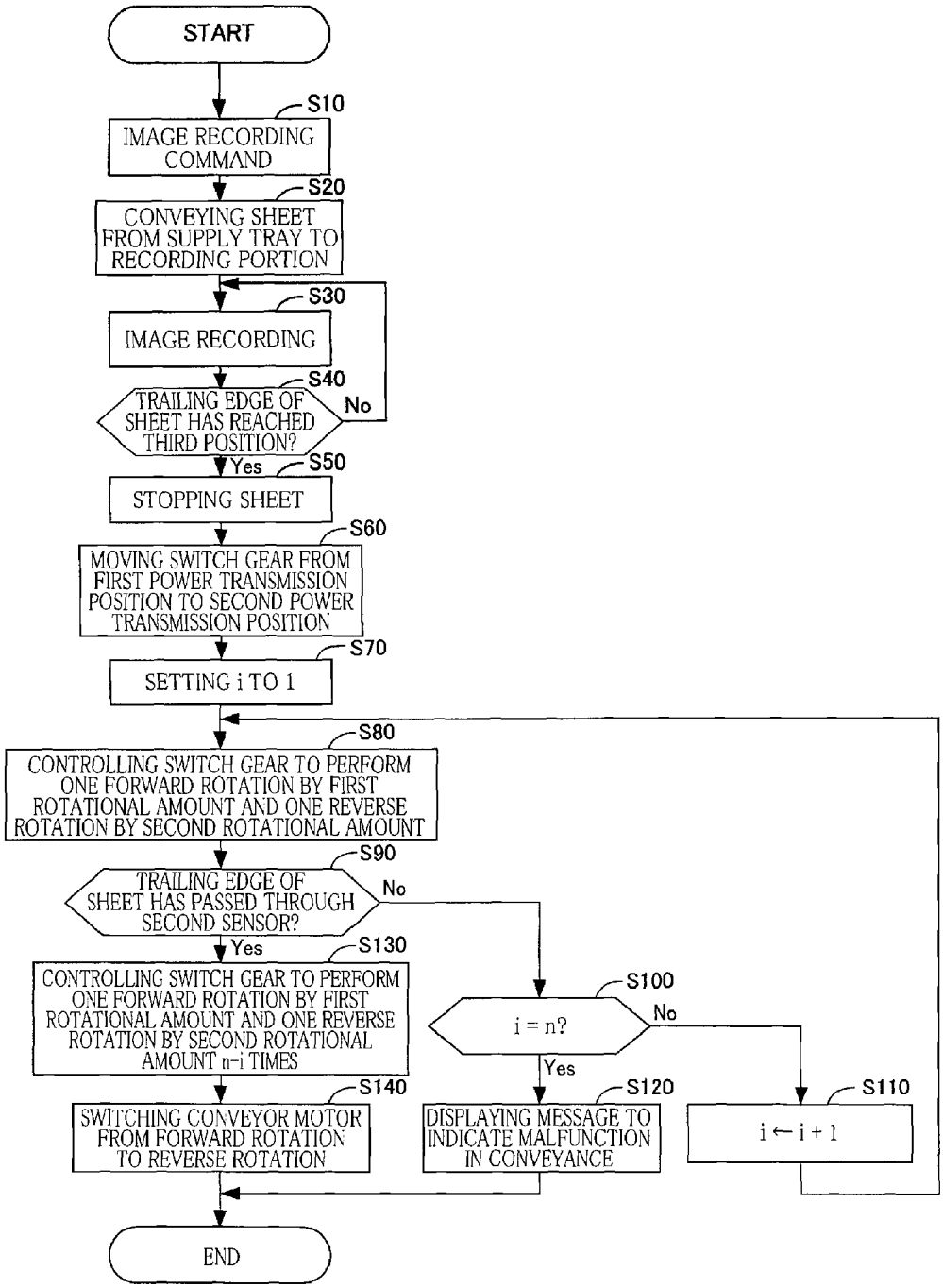
FIG. 10 is a flow chart for explaining a procedure of processings for switching a moving direction of a recording sheet 12 conveyed through a first conveyance path 65, to a rearward direction.

To solve this problem, in the present embodiment, when the switch gear 51 is moved, the controller 130 controls the conveyor motor 71 to execute a forward and reverse rotation processing indicated in a flow chart in FIG. 10. Specifically, the controller 130 rotates the conveyor motor 71 forwardly and reversely, that is, the controller 130 controls the conveyor motor 71 to make a forward and reverse rotation such that the switch gear 51 perform a forward rotation and a reverse rotation alternately a predefined number of times, i.e., n times. Here, a value of n is a design value that is a number of times of forward and reverse rotations of the switch gear 51 which ensures reliable switching of the gears. In each of the forward and reverse rotations, the conveyor motor 71 is rotated in the forward direction by a first rotational amount (as one example of a rotational amount of the forward rotation) and rotated in the reverse direction by a second rotational amount (as one example of a rotational amount of the reverse rotation). Each of the first rotational amount and the second rotational amount is smaller than a rotational amount of the conveyor motor 71 for causing one rotation of the switch gear 51 (i.e., the conveyor motor 71). Also, in the present embodiment, the rotational amount of each of the forward rotation and the reverse rotation is equal to or larger than a rotational amount that corresponds to a space between the teeth of the switch gear 51 and the output gear 75 or 88.

Here, the first rotational amount of the forward rotation of the conveyor motor 71 and the second rotational amount of the reverse rotation of the conveyor motor 71 in the forward and reverse rotation processing may be equal to each other. Nevertheless, the second rotational amount is preferably set to be smaller than the first rotational amount. With this configuration, since the rotational amount of the forward rotation of the conveyor motor 71 is larger than the rotational amount of the reverse rotation of the conveyor motor 71, the planetary gear 98 is always disengaged from the second transmission gear 101. As a result, it is possible to prevent that, when the conveyor motor 71 performs the reverse rotation, the second conveyor rollers 62 are rotated in the counterclockwise direction, i.e., the first rotational direction, to convey the recording sheet 12 in the rearward direction.

Also, a speed of the rotation (i.e., a rotational speed) of the conveyor motor 71 in the forward and reverse rotation processing is preferably considerably less than a rotational speed of the conveyor motor 71 in the image recording. Specifically, the rotational speed of the conveyor motor 71 in the forward and reverse rotation is set to be less than that of the conveyor motor 71 in conveyance of the recording sheet 12 within a period until the upstream edge of the recording sheet 12 in the first direction 15 is conveyed to a third position P which will be described below. This is because the smaller the rotational speed of the conveyor motor 71, the more easily the switch gear 51 moves. That is, the switch gear 51 and the first output gear 75 are meshed with each other more appropriately.

Also, a predefined waiting time in which the rotation of the conveyor motor 71 is stopped is preferably provided between the forward rotation and the reverse rotation of the conveyor motor 71 in the forward and reverse rotation processing. With this configuration, the switch gear 51 can be moved in its thrust directions in this waiting time. That is, the switch gear 51 and the first output gear 75 are meshed with each other more appropriately.

Also, in the forward and reverse rotation processing, the forward and reverse rotation of the conveyor motor 71 is repeated n times using the first rotational amount and the second rotational amount respectively as the rotational amount of the forward rotation of the conveyor motor 71 and the rotational amount of the reverse rotation of the conveyor motor 71, but the present invention is not limited to this configuration. For example, a rotational amount in an ith forward rotation ($i \leq n$) and a rotational amount in an (i+1)th forward rotation may differ from each other. Also, a rotational amount in an ith reverse rotation ($i \leq n$) and a rotational amount in an (i+1)th reverse rotation may differ from each other.

As thus described, the controller 130 controls the conveyor motor 71 to perform its alternate forward and reverse rotation n times, whereby the switch gear 51 is rotated in its forward direction and its reverse direction alternately. As a result, the teeth of the gears are aligned so as to be meshable with each other, ensuring smooth and reliable switching of the gears.

Controller 130

Figure 9:
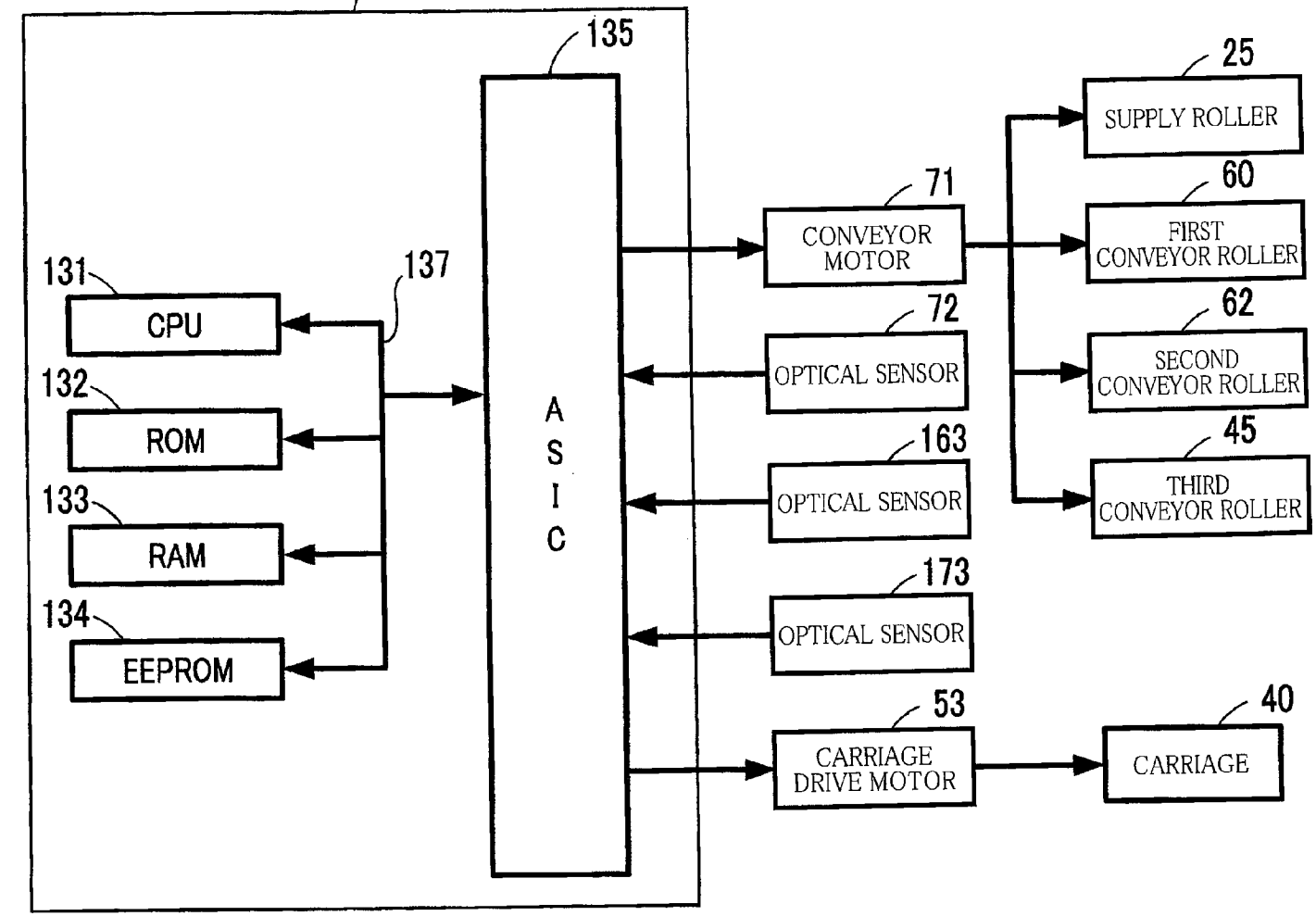
FIG. 9 is a block diagram illustrating a configuration of a controller 130.

The controller 130 illustrated in FIG. 9 controls overall operations of the MFP 10. For example, the controller 130 controls the conveyor motor 71. The controller 130 also controls the carriage drive motor 53 to move the carriage 40 in order to control the drive-power transmitting mechanism 50. As illustrated in FIG. 9, the controller 130 includes a CPU 131, a ROM 132, a RAM 133, an EEPROM 134, an ASIC 135, and an internal bus 137 for connecting these devices to one another.

The ROM 132 stores various programs and data for the CPU 131 to control various operations. The RAM 133 is used as a storage area for temporarily storing, e.g., data and signals used when the CPU 131 executes the programs. The EEPROM 134 is for storing settings, flags, and other similar data which should be kept after the MFP 10 is turned off.

Connected to the ASIC 135 are the conveyor motor 71 and the carriage drive motor 53. When a drive signal for rotating each motor is input from the CPU 131 to a corresponding drive circuit, a drive current related to the drive signal is output from the drive circuit to the motor, causing the motor to be rotated forwardly or reversely at a predetermined rotational speed.

Also, a pulse signal output from the optical sensor 72 of the rotary encoder 73 is input to the ASIC 135. On the basis of this pulse signal transmitted from the optical sensor 72, the controller 130 detects rotational amounts of the conveyor rollers 60, 62, 45.

Also, the optical sensor 163 of the first sensor 160 and the optical sensor 173 of the second sensor 170 are connected to the ASIC 135. On the basis of a signal transmitted from each of the optical sensors 163, 173, the controller 130 senses the upstream edge and the downstream edge of the recording sheet 12 in the first direction 15 at a position of a corresponding one of the sensors 160, 170.

Controls of Controller 130

There will be next explained, with reference to the flow chart in FIG. 10, a procedure or flow of processings executed by the controller 130 to switch the moving direction of the recording sheet 12 conveyed along the first conveyance path 65 to the rearward direction to guide the recording sheet 12 into the second conveyance path 67. In the following explanation, it is assumed that an initial position of the switch gear 51 is the first power transmission position.

When a command for recording an image on the recording sheet 12 is input at S10 to the MFP 10 from, e.g., an operation panel 17 (see FIG. 1), the controller 130 rotates the conveyor motor 71 in the reverse direction. This reverse rotation of the conveyor motor 71 rotates the supply rollers 25 in the clockwise direction in FIG. 2, i.e., the second rotational direction. As a result, at S20, the recording sheet 12 is supplied from the supply tray 20 into the first conveyance path 65 and conveyed in the first direction 15 along the first conveyance path 65.

Also, when the conveyor motor 71 is rotated in the reverse direction, the first conveyor roller 60 is rotated in the clockwise direction in FIG. 6, i.e., the second rotational direction. It is noted that since the switch gear 51 is located at the first power transmission position, even when the conveyor motor 71 is rotated in the reverse direction, the second conveyor rollers 62, the third conveyor rollers 45, and the fourth conveyor rollers 68 are not rotated. When the downstream edge of the recording sheet 12 in the first direction 15 reaches the first conveyor roller 60, the downstream edge is brought into contact with the first conveyor roller 60 rotating in the clockwise direction, so that oblique conveyance of the recording sheet 12 is corrected.

The controller 130 thereafter stops the conveyor motor 71. The controller 130 then rotates the conveyor motor 71 in the forward direction. This forward rotation of the conveyor motor 71 rotates the first conveyor roller 60 in the counterclockwise direction, i.e., the first rotational direction and rotates the second conveyor rollers 62 and the third conveyor rollers 45 in the clockwise direction, i.e., the second rotational direction. As a result, the recording sheet 12 is conveyed by the first conveyor roller 60 to a position just under the recording portion 24 (S20), and image recording is performed at S30 on the recording sheet 12 by the recording portion 24. The recording sheet 12 is then conveyed in the first direction 15 by the second conveyor rollers 62 and the third conveyor rollers 45.

The controller 130 at S40 determines whether the upstream edge of the recording sheet 12 in the first direction 15 has reached the third position P (see FIG. 11) or not. The determination at S40 is performed on the basis of: a result of the sensing of the downstream edge of the recording sheet 12 based on the signal output from the optical sensor 163; and a rotational amount of each of the conveyor rollers 60, 62 based on the pulse signal output from the optical sensor 72. The processing at S40 is one example of a determination processing. When the upstream edge of the recording sheet 12 in the first direction 15 has reached the third position P (S40: Yes), the controller 130 at S50 stops the recording sheet 12. It is noted that when the upstream edge of the recording sheet 12 in the first direction 15 has not reached the third position P (S40: No), this flow returns to S30 at which the image recording is performed on the recording sheet 12.

Figure 11:
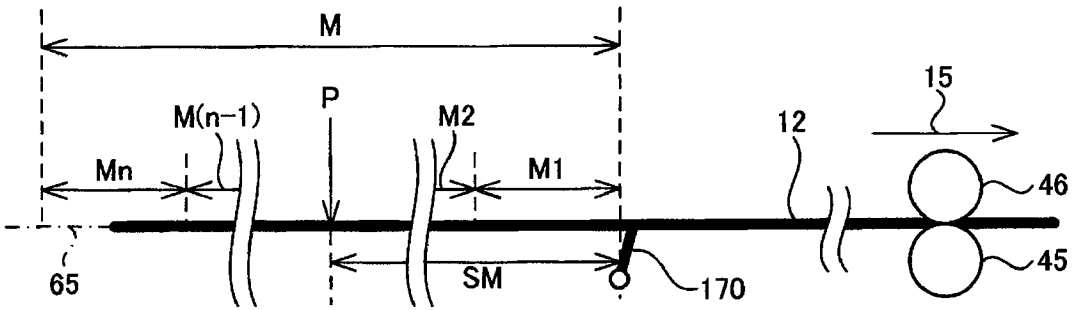
FIG. 11 is a side view schematically illustrating a positional relationship among the recording sheet 12, the first conveyance path 65, and third conveyor rollers 45, for explaining a third position P.

Here, as illustrated in FIG. 11, the third position P is upstream of the second sensor 170 in the first conveyance path 65 by a set conveyance amount (distance) SM. The set conveyance amount SM is smaller than a first conveyance amount (distance) M for which the recording sheet 12 is conveyed by n times of forward rotations of the switch gear 51 each by the first rotational amount. It is noted that each of "M1"–"Mn" in FIG. 11 indicates a unit conveyance amount for which the recording sheet 12 is conveyed by one forward rotation of the switch gear 51 by the first rotational amount. Also, FIG. 11 illustrates that the set conveyance amount SM is greater than the unit conveyance amount M1 and less than the sum of the unit conveyance amounts M1–M(n–1). Nevertheless, as long as the set conveyance amount SM is greater than zero and less than the first conveyance amount M, the set conveyance amount SM may be equal to or less than the unit conveyance amount M1 and may be greater than the sum of the unit conveyance amounts M1–M(n–1).

It is noted that when the controller 130 determines that the upstream edge of the recording sheet 12 in the first direction 15 has reached the third position P (S40: Yes), the recording sheet 12 is nipped between the third conveyor rollers 45 and the spur 46.

After stopping the conveyor motor 71 to stop the recording sheet 12 (S50), the controller 130 at S60 executes a control for moving the carriage 40 to move the switch gear 51 from the first power transmission position to the second power transmission position. That is, the controller 130 moves the carriage 40 to apply a force directed from the first power transmission position to the second power transmission position, to the switch gear 51. After starting the control for moving the switch gear 51 to the second power transmission position, the controller 130 at S70 sets a variable i to one as an initial value. The variable i is for counting the number of forward and reverse rotations of the switch gear 51. At S80, the controller 130 controls the conveyor motor 71 to perform one forward rotation by the first rotational amount and one reverse rotation by the second rotational amount.

At S90, the controller 130 determines on the basis of the signal output from the optical sensor 173 whether the state of the second sensor 170 has been switched or not. Specifically the controller 130 determines whether the level of the signal output from the optical sensor 173 has been switched from the high level to the low level or not. That is, the controller 130 determines whether the upstream edge of the recording sheet 12 in the first direction 15 has passed through the second sensor 170 or not.

When the upstream edge of the recording sheet 12 in the first direction 15 has not passed through the second sensor 170 (S90: No), the controller 130 at S100 determines the variable i is equal to n or not. When the variable i differs from n (S90: No), the controller 130 at S110 adds one to the variable i. Then, the controller 130 at S80 controls the conveyor motor 71 again to perform one forward rotation by the first rotational amount and one reverse rotation by the second rotational amount. On the other hand, when the variable i is equal to n (S100: Yes), the controller 130 at S120 controls the operation panel 17 to display a message indicating a malfunction in conveyance of the recording sheet 12.

On the other hand, when the upstream edge of the recording sheet 12 in the first direction 15 has passed through the second sensor 170 (S90: Yes), the controller 130 at S130 controls the conveyor motor 71 to perform one forward rotation by the first rotational amount and one reverse rotation by the second rotational amount n−i times. As a result, the conveyor motor 71 performs the forward and reverse rotation n times in the flow in FIG. 10.

In view of the above, the processings at S50-S80, S100, S110, and S130 are one example of a forward and reverse rotation control.

In the present embodiment, the processings of the forward and reverse rotation control are executed on condition that the upstream edge of the recording sheet 12 in the first direction 15 has reached the third position P. Also, in the present embodiment, the third position P is downstream of the recording portion 24 in the first direction 15. That is, in the present embodiment, the processings of the forward and reverse rotation control are executed on condition that the image recording on the recording sheet 12 by the recording portion 24 is completed.

Upon completion of the processing at S130, the controller 130 at S140 switches the conveyor motor 71 from the forward rotation to the reverse rotation. As a result, the recording sheet 12 having been conveyed in the first direction 15 is conveyed in the direction opposite the first direction 15.

Here, as illustrated in FIG. 2, when the upstream edge of the recording sheet 12 in the first direction 15 has already passed through the second sensor 170, the upstream edge of the recording sheet 12 in the first direction 15 has already passed through the auxiliary roller 47 provided on the flap 49. Thus, the flap 49 has already been pivoted from the discharge orientation to the flip orientation. That is, the upstream edge of the recording sheet 12 in the first direction 15 is directed toward the second conveyance path 67.

Accordingly, at S140, the recording sheet 12 conveyed in the direction opposite the first direction 15 is guided to the second conveyance path 67. In view of the above, the processing at S140 is one example of a reverse rotation control.

Second Embodiment

Figure 12:
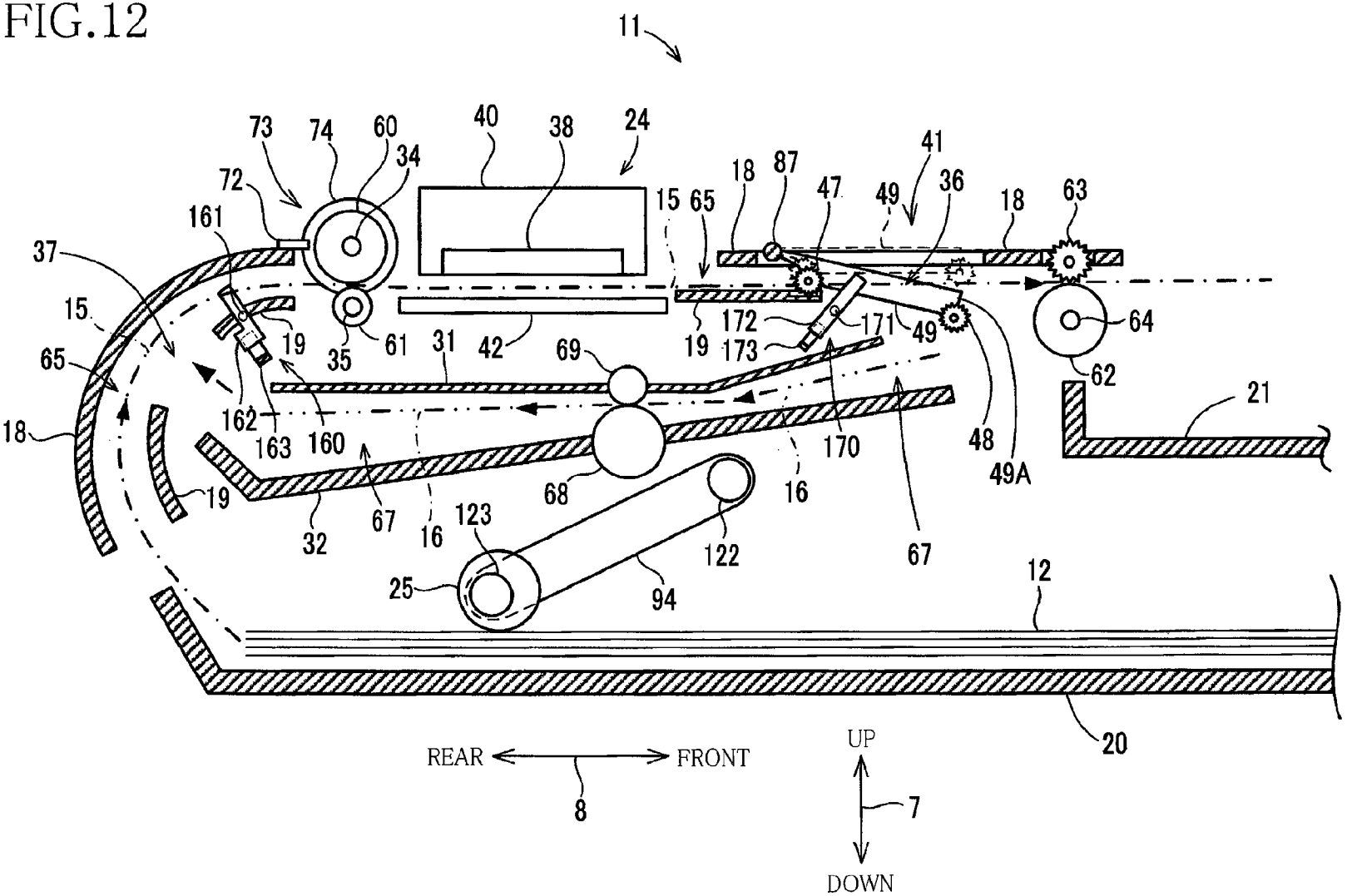
FIG. 12 is an elevational view in vertical cross section schematically illustrating an internal structure of a printing section 11 that does not include the third conveyor rollers 45 and a spur 46 in FIG. 2.

The present invention may be applied to a second embodiment as illustrated in FIG. 12. This second embodiment mainly omits the third conveyor rollers 45, the spur 46, and the third power transmitter 33 in the first embodiment. Also, the second conveyance path 67 extends from a position between the recording portion 24 and the second conveyor rollers 62 to an upstream side of the first conveyor roller 60 in the first direction 15. In this second embodiment, the second conveyor rollers 62 are one example of the second roller. Also, the second power transmitter 27 is one example of the second power transmitter. Also, the second transmission gear 101 is one example of the driving gear mechanism.

Effects

The forward and reverse rotation processing of the conveyor motor 71 (in FIG. 10) is a processing required for appropriate meshing engagement between the switch gear 51 and the first output gear 75 or the second output gear 88. In the forward rotation of the forward and reverse rotation processing, the rotational driving power of the first conveyor roller 60 in the first rotational direction is transmitted by the first power transmitter 26 to the second conveyor rollers 62 and the third conveyor rollers 45. Also, when the forward and reverse rotation processing is started, the upstream edge of the recording sheet 12 in the first direction 15 is located at the third position P located upstream of the second sensor 170, and accordingly the upstream edge is downstream of the first conveyor roller 60 and the second conveyor rollers 62 in the first direction 15. Therefore, in the forward rotation of the forward and reverse rotation processing, the recording sheet 12 is conveyed in the first direction 15 by the third conveyor rollers 45 by a distance corresponding to the first rotational amount.

On the other hand, in the reverse rotation of the forward and reverse rotation processing, the rotational driving power of the first conveyor roller 60 in the second rotational direction is not transmitted to the third conveyor rollers 45 by the first power transmitter 26. Also, the rotational driving power is not transmitted to the third conveyor rollers 45 by the second power transmitter 27, either. This is because the first rotational amount is a small amount that is less than a rotational amount for one rotation of the conveyor motor 71, and consequently the planetary gear 98 is not revolved in the reverse rotation of the forward and reverse rotation processing by such an amount that the planetary gear 98 is switched from the separated state in which the planetary gear 98 is spaced apart from the second transmission gear 101 to the connected state in which the planetary gear 98 is connected to and meshed with the second transmission gear 101. In view of the above, when the forward rotation of the switch gear 51 by the first rotational amount and the reverse rotation of the switch gear 51 by the second rotational amount are performed n times at S50-S80, S100, S110, and S130 in FIG. 10, the recording sheet 12 is conveyed by the third conveyor rollers 45 by a distance obtained by multiplying the first rotational amount by n. Also, since the first rotational amount is considerably smaller than the rotational amount of the conveyor motor 71 in the image recording, a conveyance amount of the recording sheet 12 in the forward rotation in the forward and reverse rotation control is considerably small.

Here, in the above-described embodiments, the processings at S50-S80, S100, S110, and S130 are executed when the upstream edge of the recording sheet 12 in the first direction 15 has reached the third position P. Thus, the upstream edge of the recording sheet 12 in the first direction 15 is sensed by the second sensor 170 in n times of the forward and reverse rotations of the conveyor motor 71 at S50-S80, S100, S110, and S130. Also, as described above, the conveyance amount of the recording sheet 12 in the forward rotation at S50-S80, S100, S110, and S130 is considerably small. Therefore, the conveyance amount of the recording sheet 12 after the upstream edge of the recording sheet 12 in the first direction 15 is sensed by the second sensor 170 can be made considerably small.

Also, in the above-described embodiments, the recording sheet 12 is conveyed in the first direction 15 not only by normal rotations (i.e., the rotations in the first rotational direction) of the first conveyor roller 60 and the second conveyor rollers 62 but also by repetitive operation for switching the gears. That is, in the above-described embodiments, the recording sheet 12 is conveyed also by driving of the conveyor motor 71 not for conveying the recording sheet 12. That is, the recording sheet 12 is efficiently conveyed.

In view of the above, in the above-described embodiments, even in a case where the recording sheet 12 is conveyed at a high speed under normal conditions (e.g., for the image recording), when the upstream edge of the recording sheet 12 in the first direction 15 is sensed by the second sensor 170, the recording sheet 12 is intermittently conveyed by the considerably small conveyance amount under the control of the controller 130. Thus, in the above-described embodiments, it is possible to suppress a reduction in accuracy of sensing the recording sheet 12 by the second sensor 170 that is used for sensing or determining a timing for conveying the recording sheet 12 into the second conveyance path 67.

In the above-described embodiments, the second rotational driving power is not transmitted to the second conveyor rollers 62 by the first power transmitter 26 in the reverse rotation of the forward and reverse rotation processing. Also, in the above-described embodiments, the second rotational amount is smaller than the rotational amount required for switching the first planetary gear mechanism 96 from the separated state to the connected state. Thus, the second rotational driving power is not transmitted to the second conveyor rollers 62 by the second power transmitter 27, either. Therefore, in the above-described embodiments, it is possible to prevent the recording sheet 12 from being conveyed in the rearward direction by the reverse rotation of the conveyor motor 71 in the forward and reverse rotation processing.

Also, in the above-described embodiments, the first power transmitter 26 transmits the first rotational driving power from the first conveyor roller 60 to the second conveyor rollers 62 and the third conveyor rollers 45 via the second belt 83 and the third belt 86, but the one-way clutch of the first power transmitter 26 does not cause the second rotational driving power to be transmitted to the second conveyor rollers 62 and the third conveyor rollers 45. In view of the above, the configuration in the above-described embodiments is preferable to realize the function of the first power transmitter 26.

Also, if the second rotational amount is larger than the rotational amount required for switching the first planetary gear mechanism 96 from the separated state to the connected state, the recording sheet 12 may be conveyed in the rearward direction by the reverse rotation of the conveyor motor 71 in the forward and reverse rotation processing. However, in the above-described embodiments, the first rotational amount in the forward rotation is larger than the second rotational amount in the reverse rotation, preventing the recording sheet 12 from being conveyed in the rearward direction in the forward and reverse rotation processing of the conveyor motor 71. Thus, in the above-described embodiments, the recording sheet 12 can reach the second sensor 170 early.

Also, when the rotational speed of the conveyor motor 71 is slow in the forward and reverse rotation processing, the rotational speed of the switch gear 51 is also slow. As a result, when the switcher 30 switches the engagement of the switch gear 51, the switch gear 51 moved to the second position and the first output gear 75 can be smoothly meshed with each other.

Also, in the above-described embodiments, the switch gear 51 becomes movable in a direction in which the switch gear 51 is meshed with the first output gear 75 in thrust directions of the switch gear 51 while the conveyor motor 71 is stopped. As a result, the switch gear 51 moved to the second position and the first output gear 75 can be smoothly meshed with each other.

Also, in the above-described embodiments, the first rotational amount is the small amount that is less than the rotational amount for one rotation of the conveyor motor 71. Furthermore, since the third position P is located as in the above-described embodiments, the recording sheet 12 can be conveyed through the second sensor 170 in the forward and reverse rotation processing.

Also, in the above-described embodiments, the controller 130 at S140 controls the conveyor motor 71 such that the recording sheet 12 whose upstream edge in the first direction 15 has reached the second sensor 170 is conveyed in the direction opposite the first direction 15. As a result, the recording sheet 12 is guided from the first conveyance path 65 to the second conveyance path 67. That is, in the above-described embodiments, the recording sheet 12 can be guided to the second conveyance path 67 for the duplex image recording. In view of the above, the configuration in the above-described embodiments is preferable to realize the duplex image recording in the MFP 10.

Also, if the forward and reverse rotation of the switch gear 51 is performed in the image recording on the recording sheet 12, there is a possibility of causing a problem that the recording sheet 12 is conveyed by the forward rotation of the conveyor motor 71, and an image is recorded on an unintended area on the recording sheet 12. In the above-described embodiments, however, the controller 130 starts the forward and reverse rotation of the switch gear 51 on condition that the image recording on the recording sheet 12 is completed, thereby preventing occurrence of such a problem.

What is claimed is:

1. An image recording apparatus, comprising:

a first motor configured to perform a forward rotation and a reverse rotation;

a first roller rotatable to produce a rotational driving power, wherein, when the first motor performs the forward rotation, the first roller is rotated in a first rotational direction to produce a first rotational driving power and to convey a sheet in a conveying direction along a conveyance path, and wherein, when the first motor performs the reverse rotation, the first roller is rotated in a second rotational direction reverse to the first rotational direction to produce a second rotational driving power;

a second motor configured to perform a forward rotation and a reverse rotation;

a recording portion provided downstream of the first roller in the conveying direction and movable in main scanning directions perpendicular to the conveying direction by the forward rotation and the reverse rotation of the second motor to record an image on the sheet;

a second roller provided downstream of the recording portion in the conveying direction;

a first power transmitter configured to transmit the first rotational driving power of the first roller to the second roller to rotate the second roller in a third rotational direction for conveying the sheet in the conveying direction;

a second power transmitter configured to transmit the second rotational driving power of the first roller to the second roller to rotate the second roller in a fourth rotational direction that is reverse to the third rotational direction;

a first sensor portion provided upstream of the first roller in the conveying direction and configured to produce a first sense signal when the sheet is conveyed through the first sensor portion;

a second sensor portion configured to produce a second sense signal when the first roller is rotated;

a third sensor portion provided between the recording portion and the second roller in the conveying direction and configured to produce a third sense signal when the sheet is conveyed through the third sensor portion;

a switcher configured to switch whether the rotational driving power of the first roller is transmitted to the second power transmitter; and a controller configured to control the first motor and the second motor based on at least one of the first sense signal, the second sense signal, and the third sense signal, wherein the switcher comprises:

a first gear movable between a first position and a second position by movement of the recording portion and configured to rotate in conjunction with rotation of the first roller;

a second gear meshable with the first gear located at the second position, the second gear being configured to transmit the rotational driving power of the first roller to the second power transmitter when the second gear is meshed with the first gear located at the second position; and a force apply portion configured to apply a force to the first gear in a direction directed from the first position toward the second position, and wherein the controller is configured to execute:

a determination processing in which the controller determines, based on the first sense signal and the second sense signal, whether an upstream edge of the sheet in the conveying direction has reached a third position located between the recording portion and the third sensor portion in the conveying direction; and a forward and reverse rotation control in which, when the controller determines that the upstream edge of the sheet in the conveying direction has reached the third position in the determination processing, the controller starts driving the second motor to move the first gear from the first position to the second position and thereafter controls the first motor to perform the forward rotation and the reverse rotation alternately a set number of times.

2. The image recording apparatus according to claim 1, wherein the second power transmitter includes:

a driving gear mechanism configured to drive the second roller; and a planetary gear mechanism configured to be switched between (i) a separated state in which the planetary gear mechanism receives the first rotational driving power transmitted from the second gear such that the planetary gear mechanism is decoupled from the driving gear mechanism by the first rotational driving power and (ii) a connected state in which the planetary gear mechanism receives the second rotational driving power transmitted from the second gear such that the planetary gear mechanism is coupled to the driving gear mechanism by the second rotational driving power, the planetary gear mechanism being configured to transmit the second rotational driving power to the second roller in the connected state, and wherein a rotational amount of the reverse rotation of the first motor in the forward and reverse rotation control is less than a rotational amount of the reverse rotation of the first motor which is required for switching the planetary gear mechanism from the separated state to the connected state.

3. The image recording apparatus according to claim 2, wherein the first power transmitter includes:

a first pulley configured to rotate in conjunction with the rotation of the first roller;

a second pulley comprising a one-way clutch function in which the second pulley rotates the second roller when the first rotational driving power is transmitted from the first roller to the second pulley, and the second pulley does not rotate the second roller when the second rotational driving power is transmitted from the first roller to the second pulley; and a belt looped between the first pulley and the second pulley.

4. The image recording apparatus according to claim 1, further comprising a path forming member configured to form a flip conveyance path extending from a position between the recording portion and the second roller in the conveying direction, toward a position upstream of the first roller in the conveying direction in the conveyance path, wherein the flip conveyance path is branched off from the conveyance path at a branch portion located between the recording portion and the second roller in the conveying direction, and the third sensor portion is disposed at the branch portion.

5. The image recording apparatus according to claim 1, wherein the controller is configured to drive the first motor in the forward and reverse rotation control such that a rotational amount of the forward rotation of the first motor is greater than that of the reverse rotation of the first motor.

6. The image recording apparatus according to claim 1, wherein the controller is configured to control the first motor to perform the forward rotation and the reverse rotation in the forward and reverse rotation control such that a rotational speed of the first motor in the forward and reverse rotation control is less than that of the first motor in conveyance of the sheet within a period until the upstream edge of the sheet in the conveying direction reaches the third position.

7. The image recording apparatus according to claim 1, wherein the controller is configured to execute the forward and reverse rotation control such that the controller stops the first motor for equal to or greater than a set period, between an end of the forward rotation to a start of the reverse rotation or between an end of the reverse rotation to a start of the forward rotation.

8. The image recording apparatus according to claim 1, wherein a forward rotational amount that is a rotational amount of the forward rotation of the first motor in the forward and reverse rotation control and is equal to or less than a rotational amount required for one rotation of the first motor, and wherein the third position is upstream of the third sensor portion in the conveying direction by a distance for which the sheet is conveyed by the set number of times of forward rotations of the first motor each by the forward rotational amount.

9. The image recording apparatus according to claim 1, wherein the controller is configured to, after controlling the first motor to perform the forward rotation and the reverse rotation the set number of times in the forward and reverse rotation control, execute a reverse rotation control in which the controller controls the first motor to perform the reverse rotation to convey the sheet toward an upstream side in the conveying direction.

* * * * *